US007379685B2

(12) United States Patent
Tatematsu et al.

(10) Patent No.: US 7,379,685 B2
(45) Date of Patent: May 27, 2008

(54) IMAGE HEATING APPARATUS

(75) Inventors: Hideki Tatematsu, Ashiya (JP); Hirofumi Ihara, Fukuoka (JP); Tadafumi Shimizu, Ogori (JP); Masahiro Samei, Toyonaka (JP); Keiichi Matsuzaki, Kurume (JP); Tomoyuki Noguchi, Kasuga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 424 days.

(21) Appl. No.: 10/554,945

(22) PCT Filed: Mar. 7, 2005

(86) PCT No.: PCT/JP2005/003889

§ 371 (c)(1),
(2), (4) Date: Oct. 31, 2005

(87) PCT Pub. No.: WO2005/088407

PCT Pub. Date: Sep. 22, 2005

(65) Prior Publication Data

US 2007/0036570 A1 Feb. 15, 2007

(30) Foreign Application Priority Data

Mar. 10, 2004 (JP) ..... 2004-068032

(51) Int. Cl.
*G03G 15/20* (2006.01)

(52) U.S. Cl. ..... 399/69

(58) Field of Classification Search ..... 399/69, 399/70

See application file for complete search history.

(56) References Cited

U.S. PATENT DOCUMENTS

| | | | | |
|---|---|---|---|---|
| 5,789,723 | A * | 8/1998 | Hirst | 219/216 |
| 6,628,917 | B2 * | 9/2003 | Lee | 399/330 |
| 2002/0106211 | A1 | 8/2002 | Suzuki et al. | |
| 2002/0146253 | A1 | 10/2002 | Kondo et al. | |
| 2005/0041991 | A1 | 2/2005 | Ihara et al. | |
| 2005/0199613 | A1 | 9/2005 | Samei et al. | |

(Continued)

FOREIGN PATENT DOCUMENTS

| | | |
|---|---|---|
| JP | 61-075409 | 4/1986 |

(Continued)

OTHER PUBLICATIONS

English Language Abstract of JP 2002-169410.

(Continued)

*Primary Examiner*—Ryan Gleitz
(74) *Attorney, Agent, or Firm*—Greenblum & Berstein, P.L.C.

(57) ABSTRACT

An image heating apparatus that enables a temperature of an image heating element to be stably maintained at a target temperature as a fixing speed varies. A Proportional-Integral-Derivative (PID) controller determines whether a temperature control computation results in a range that allows temperature control with one IGBT, and a linear control is performed if the result is at least equal to a minimum power obtained as IH output. PWM control is performed at minimum power if the power is less than a required minimum power. Thus, a computation method of a supply power computator need not be switched according to the fixing speed, and a calorific value of a fixing belt can be controlled using one computation method.

10 Claims, 21 Drawing Sheets

U.S. PATENT DOCUMENTS

2005/0201768 A1 9/2005 Tatematsu et al.

FOREIGN PATENT DOCUMENTS

| | | |
|---|---|---|
| JP | 7-175363 | 7/1995 |
| JP | 9-006180 | 1/1997 |
| JP | 2000-259018 | 9/2000 |
| JP | 2002-169410 | 6/2002 |
| JP | 2002-304083 | 10/2002 |

OTHER PUBLICATIONS

English Language Abstract of JP 2002-304083.
English Language Abstract of JP 9-006180.
English Language Abstract of JP 2000-259018.
English Language Abstract of JP 7-175363.
English Language Abstract of JP 61-075409.

* cited by examiner

NOTATION :

| | |
|---|---|
| VOLTAGE VALUE | :Vval [volt] |
| CURRENT VALUE | :Ival [amp] |
| VOLTAGE AD VALUE | :ADv |
| CURRENT AD VALUE | :ADi |

100V SYSTEM/50Hz

$Vval=0.7112\times ADv-33.0290$ [volt] ··· EQUATION 5-1

$Ival=0.0533\times ADi-1.5059$ [amp] ··· EQUATION 5-2

100V SYSTEM/60Hz

$Vval=0.7148\times ADv-33.1930$ [volt] ··· EQUATION 5-3

$Ival=0.0535\times ADi-1.6145$ [amp] ··· EQUATION 5-4

200V SYSTEM/50Hz

$Vval=1.4048\times ADv-63.7730$ [volt] ··· EQUATION 5-5

$Ival=0.0269\times ADi-0.8516$ [amp] ··· EQUATION 5-6

200V SYSTEM/60Hz

$Vval=1.4048\times ADv-63.7730$ [volt] ··· EQUATION 5-7

$Ival=0.0268\times ADi-0.9182$ [amp] ··· EQUATION 5-8

FIG. 5

< 100V SYSTEM >

| POWER SOURCE VOLTAGE | MINIMUM POWER(w) |
|---|---|
| V<80v | 450 |
| 80v≦V<85v | 462.5 |
| 85v≦V<90v | 475 |
| 90v≦V<95v | 487.5 |
| 95v≦V<100v | 500 |
| 100v≦V<105v | 525 |
| 105v≦V<110v | 550 |
| 110v≦V<115v | 575 |
| 115v≦V<120v | 600 |
| 120v≦V<122.5v | 630 |
| 122.5v≦V<125v | 660 |
| 125v≦V<127.5v | 690 |
| 127.5v≦V<130v | 720 |
| 130v≦V<132.5v | 750 |
| 132.5v≦V<135v | 775 |
| 135v≦V | 800 |

FIG.7A

< 200V SYSTEM >

| POWER SOURCE VOLTAGE | MINIMUM POWER(w) |
|---|---|
| V<185v | 300 |
| 185v≦V<195v | 324 |
| 195v≦V<205v | 348 |
| 205v≦V<215v | 405 |
| 215v≦V<225v | 461 |
| 225v≦V<235v | 518 |
| 235v≦V<245v | 574 |
| 245v≦V<255v | 630 |
| 255v≦V<265v | 687 |
| 265v≦V<275v | 743 |
| 275v≦V | 800 |

FIG.7B

< 100V SYSTEM >

| POWER SOURCE VOLTAGE | RegVal(min)COMPUTATION EQUATION | |
|---|---|---|
| V<80v | RegVal=0.0095×V×V+256.35−2.8075×V | EQUATION 9 − 1 |
| 80v≦V<85v | RegVal=0.0103×V×V+269.08−3.0034×V | EQUATION 9 − 2 |
| 85v≦V<90v | RegVal=0.0098×V×V+267.45−2.9311×V | EQUATION 9 − 3 |
| 90v≦V<95v | RegVal=0.0105×V×V+277.55−3.0939×V | EQUATION 9 − 4 |
| 95v≦V<100v | RegVal=0.0113×V×V+288.95−3.2668×V | EQUATION 9 − 5 |
| 100v≦V<105v | RegVal=0.0118×V×V+301.85−3.4279×V | EQUATION 9 − 6 |
| 105v≦V<110v | RegVal=0.0117×V×V+306.45−3.4405×V | EQUATION 9 − 7 |
| 110v≦V<115v | RegVal=0.0129×V×V+324.53−3.7273×V | EQUATION 9 − 8 |
| 115v≦V<120v | RegVal=0.0133×V×V+334.73−3.8423×V | EQUATION 9 − 9 |
| 120v≦V<122.5v | RegVal=0.0138×V×V+344.85−3.9646×V | EQUATION 9 − 10 |
| 122.5v≦V<125v | RegVal=0.0142×V×V+356.88−4.1027×V | EQUATION 9 − 11 |
| 125v≦V<127.5v | RegVal=0.0145×V×V+365.25−4.1875×V | EQUATION 9 − 12 |
| 127.5v≦V<130v | RegVal=0.0146×V×V+373.58−4.2534×V | EQUATION 9 − 13 |
| 130v≦V<132.5v | RegVal=0.0149×V×V+382.38−4.3527×V | EQUATION 9 − 14 |
| 132.5v≦V<135v | RegVal=0.0149×V×V+386.78−4.3755×V | EQUATION 9 − 15 |
| 135v≦V | RegVal=0.0150×V×V+391.60−4.4129×V | EQUATION 9 − 16 |

FIG.9A

< 200V SYSTEM >

| POWER SOURCE VOLTAGE | RegVal(min)COMPUTATION EQUATION | |
|---|---|---|
| V<185v | RegVal=0.0017×V×V+220.36−1.1179×V | EQUATION 9 − 17 |
| 185v≦V<195v | RegVal=0.0018×V×V+228.27−1.1582×V | EQUATION 9 − 18 |
| 195v≦V<205v | RegVal=0.0020×V×V+245.84−1.2776×V | EQUATION 9 − 19 |
| 205v≦V<215v | RegVal=0.0023×V×V+269.77−1.4143×V | EQUATION 9 − 20 |
| 215v≦V<225v | RegVal=0.0024×V×V+290.69−1.5181×V | EQUATION 9 − 21 |
| 225v≦V<235v | RegVal=0.0025×V×V+314.62−1.6548×V | EQUATION 9 − 22 |
| 235v≦V<245v | RegVal=0.0030×V×V+346.10−1.8577×V | EQUATION 9 − 23 |
| 245v≦V<255v | RegVal=0.0030×V×V+358.33−1.8926×V | EQUATION 9 − 24 |
| 255v≦V<265v | RegVal=0.0033×V×V+387.66−2.0702×V | EQUATION 9 − 25 |
| 265v≦V<275v | RegVal=0.0037×V×V+415.73−2.2425×V | EQUATION 9 − 26 |
| 275v≦V | RegVal=0.0038×V×V+437.73−2.3590×V | EQUATION 9 − 27 |

FIG.9B

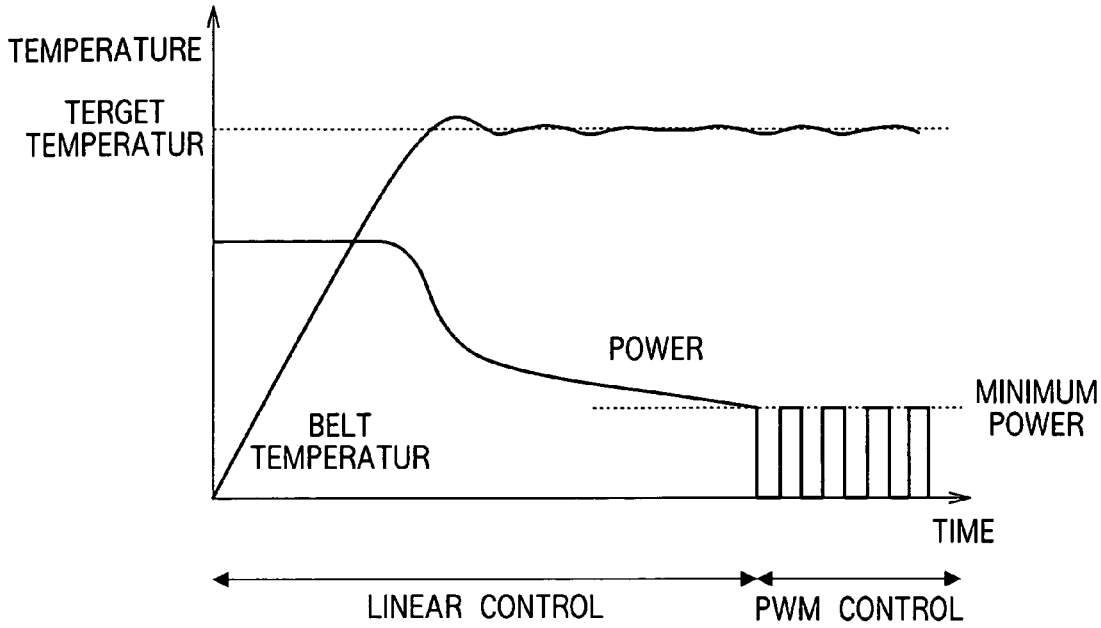
FIG.13
| POWER SOURCE VOLTAGE | ~90V | 90V~100V | 100V~110V | 120V~ |
|---|---|---|---|---|
| MINIMUM POWER | 450W | 500W | 550W | 600W |
FIG.14
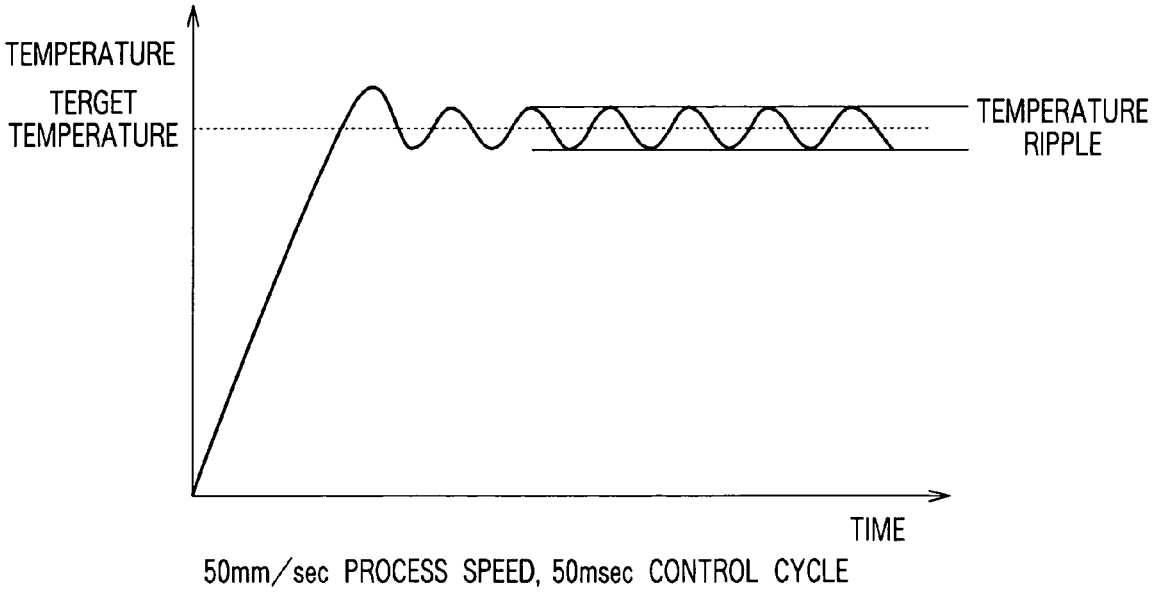
FIG.15

200mm/sec PROCESS SPEED, 200msec CONTROL CYCLE

| | SAMPLING CYCLE | | |
|---|---|---|---|
| PROCESS SPEED | 50ms | 100ms | 200ms |
| 50mm/s | 10 ℃ | 7 ℃ | 5 ℃ |
| 100mm/s | 4 ℃ | 3 ℃ | 5 ℃ |
| 200mm/s | 3 ℃ | 4 ℃ | 6 ℃ |

100%(10/10)

60%(6/10)

20%(2/10)

65%(13/20)

80%(4/5)

10%

20%

30%

40%

50%

IMAGE HEATING APPARATUS

TECHNICAL FIELD

The present invention relates to an image heating apparatus that heats an unfixed image on a recording medium, and, more particularly, to an image heating apparatus useful for employment in a fixing apparatus of an image forming apparatus such as an electrophotographic or electrostatographic copier, facsimile machine, or printer.

BACKGROUND ART

An induction heating (IH) type of image heating apparatus is known as an image heating apparatus of this kind. This image heating apparatus generates an eddy current through the action of a magnetic field generated by an induction heating apparatus upon an image heating element, and heats an unfixed image on a recording medium such as transfer paper or an OHP (Over Head Projector) sheet through Joule heating of the image heating element by means of this eddy current.

This IH image heating apparatus has the advantage of higher heat production efficiency and faster fixing speed than an image heating apparatus that uses a halogen lamp as the heat source of the heat-producing section that heats the image heating element. Also, with an image heating apparatus that uses a thin sleeve, belt, or the like, as the image heating element, the thermal capacity of the image heating element is small, and the image heating element can be made to produce heat in a short time, enabling startup responsiveness to be greatly improved.

With an IH image heating apparatus, the image heating element is normally maintained at a predetermined fixing temperature (target temperature) by having power supplied to the heat source controlled by a value calculated from a predetermined control rule in accordance with the temperature detected by a temperature detection section located in contact with or close to the image heating element.

With this PID control, not only is the operation amount of the power control section made proportional to deviation between the temperature detected by the temperature detection section and the target temperature of the image heating element based on the development increase/decrease trend, but a factor proportional to a deviation integral and a factor proportional to a deviation derivative are also taken into consideration in performing control.

Also, temperature information from the temperature detection section is sampled in a certain cycle (sampling cycle), and is incorporated into the control rule for PID control.

With this kind of image heating apparatus, to increase the glossiness of a fixed image, or improve the transparency of a fixed image on an OHP sheet, a slower fixing speed than normal is used. Furthermore, with this kind of image heating apparatus, a slower fixing speed than normal is also employed when using a recording medium such as thick paper that requires a large amount of heat for heat-fixing of an unfixed image.

However, with an IH image heating apparatus, when the power supplied to the heat source is controlled by means of the above-described PID control, if the fixing speed varies according to the type of recording medium undergoing heat-fixing, there is a risk that temperature control of the image heating element will become unstable.

That is to say, the image heating element of an IH image heating apparatus rises in temperature through the supply of a predetermined amount of heat by the heat source, but, since the heat production efficiency of the image heating element is high, when the fixing speed changes the amount of heat received from the heat source also changes. For example, if the fixing speed is halved, the amount of heat received by the image heating element from the heat source approximately doubles. Consequently, in this kind of image heating apparatus, even if the power input to the heat source is fixed, the speed of a rise in temperature of the image heating element increases when the fixing speed is reduced.

Also, with this kind of image heating apparatus, there is a certain time lag between execution of power adjustment as a result of PID control computation and detection of the temperature change of the image heating element that is the result of this control.

Thus, with this kind of image heating apparatus, this time lag is taken into consideration in deciding the sampling time for detected temperature information from the temperature detection section. However, with this kind of image heating apparatus, when the fixing speed changes, this sampling time shifts, and the PID control results cannot be fed back accurately.

Thus, a deficiency of this kind of image heating apparatus is that, since the speed of a rise in temperature of the image heating element and the sampling time change due to a change in the fixing speed, PID control of the amount of power supplied to the heat source cannot be performed optimally, and the temperature of the image heating element fluctuates above and below the target temperature.

That is to say, with an image heating apparatus that performs PID control of the amount of power supplied to the heat source, when the fixing speed is slow, variation of the temperature of the image heating element in response to variation of the supply power is large, and, when the value of PID control proportional gain K is large, the results of computation of the operation amount of a switching element (IGBT: Insulated Gate Bipolar Transistor) due to PID control are prone to swing. Thus, when the fixing speed is slow, the temperature of the image heating element fails to converge to the target temperature due to overshoot and so forth. On the other hand, when the fixing speed is fast, if the value of PID control proportional gain K is small, the operation amount of the switching element cannot keep up with temperature variations of the image heating element due to disturbances.

Thus, a problem with this kind of image heating apparatus is that it is not possible to achieve uniform gloss of a fixed image on a recording medium in-plane or uniform transparency of an image on an OHP sheet due to swings in the temperature of the image heating element as described above. Furthermore, a problem with this kind of image heating apparatus is the occurrence of fixing defects known as hot offset and cold offset if the temperature of the image heating element moves outside a temperature range within which fixing is possible that includes the target temperature.

Thus, an image heating apparatus has been proposed whereby the method of deciding the operation amount of a switching element by means of PID control is varied according to the rotational speed of fixing film acting as the image heating element (see Patent Document 1, for example).

In the image heating apparatus disclosed in Patent Document 1, the slower the fixing speed (the rotational speed of the fixing film), the smaller is the value of PID control proportional gain K. For example, in this image heating apparatus there is a proportional gain K table for three fixing speeds, proportional gain K corresponding to the current fixing speed is referenced from this table in accordance with a drive speed signal, and switching element on/off times are calculated according to the PID control rule. Then, with this image heating apparatus, temperature control of the fixing film is performed by adjusting the time of voltage application to an exciting coil functioning as the heat source by means of these switching element on/off operations. Patent Document 1: Unexamined Japanese Patent Publication No. 2002-169410

DISCLOSURE OF INVENTION

Problems to be Solved by the Invention

However, with the above-described conventional image heating apparatus, the PID control computation method is changed according to the rotational speed of the image heating element, and power source output to the heat source is performed only by linear control. With this linear control, if the control range is wide, such as 100 W to 1000 W, for example, two or more IGBTs—the power source switching elements that perform PID control of the power supplied to the heat source—are used. This is because power source output would become unstable and accurate control would not be possible if one IGBT were used for the kind of wide-range power control described above.

That is to say, with this kind of conventional image heating apparatus, the power source switching element control range for PID control of power supplied to the heat source is divided into two areas of 100 W to 500 W and 500 W to 1000 W, for example, and linear control is performed separately for each area by two IGBTs.

Thus, a deficiency with this kind of conventional image heating apparatus is that, since a plurality of IGBTs are used for PID control of power supplied to the heat source, cost is high and efficiency is poor.

Consequently, from the standpoint of low cost and high efficiency, it is desirable for this kind of image heating apparatus to have a configuration in which one IGBT is used for the power source. However, a drawback of an image heating apparatus with such a configuration is that high-frequency switching loss increases at low power, and minimum power only falls to around 400 W as IH output.

As stated above, the PID control method is generally used for IH temperature control. While this controls the operation amount of the power control section according to the deviation between the detected temperature and target temperature, when the operation amount does not fall below a certain value, it is used in combination with PWM (Pulse Width Modulation) control.

PWM control varies the pulse width within the sampling cycle, and creates pseudo output equivalent to the on duty. However, with PWM control, the pulse width cannot actually be changed steplessly, but depends on the control cycle of the image forming apparatus in which the image heating apparatus is installed. For example, with PWM control, if the control cycle of the image forming apparatus is 10 ms, and the sampling cycle is 100 ms, pulse widths are obtained in 10 steps.

Therefore, with PWM control, if the sampling cycle is long, finely-stepped control can be performed, but, since the cycle is long, it takes time for the operation amount to be reflected. Also, with PWM control, if the sampling cycle is short, the operation amount can be reflected immediately, but the operation amount is only coarsely controlled. Furthermore, with PWM control, when performing thick paper or OHP sheet fixing, fixing is generally performed at a speed lower than the normal fixing speed, and there is a problem of temperature control becoming unstable when the fixing speed changes.

That is to say, with PWM control, when the fixing speed changes, although the amount of heat supplied per unit time by the heat-producing section that heats the image heating element is the same, the rate of consumption of the supplied heat changes, and therefore the reaction to control becomes correspondingly hypersensitive as the fixing speed decreases.

Furthermore, with an image heating apparatus that uses a belt of low thermal capacity, as described above, the heating part of the image heating element and the detection part of the temperature detection section are at a distance from each other, and therefore the time lag until the result of heating is detected is greater the slower the fixing speed is. Consequently, with this image heating apparatus, control results are not feed back accurately unless control is performed using a sampling cycle appropriate to the time lag.

Thus, with the above-described conventional image heating apparatus, if the sampling cycle is not appropriate, when the fixing speed is low, in particular, temperature control becomes turbulent and large temperature ripple occurs oscillating above and below the target temperature.

Also, with the above-described conventional image heating apparatus, if the PWM control sampling cycle is long, fine control can be achieved, but it takes time for control results to be reflected in the output.

It is therefore an object of the present invention to provide an image heating apparatus that enables the temperature of an image heating element to be maintained stably at a target temperature even when the fixing speed varies, and that enables lower cost and higher efficiency to be achieved.

Means for Solving the Problem

An image heating apparatus of the present invention employs a configuration comprising: an image heating element that heats an unfixed image on a recording medium; a heat-producing section that heats the image heating element; a temperature detection section that detects the temperature of the image heating element; and a calorific value control section that controls the calorific value of the heat-producing section based on the temperature detected by the temperature detection section so that the temperature of the image heating element is maintained at an image fixing temperature suitable for heat-fixing of the unfixed image onto the recording medium, wherein the calorific value control section controls the calorific value of the heat-producing section by switching between linear control and PWM control at predetermined reference power.

Advantageous Effect of the Invention

The present invention enables the temperature of an image heating element to be maintained stably at a target temperature even when the fixing speed varies. Furthermore, the present invention has only one IGBT used for the power source, and can therefore be configured at low cost and with high efficiency.

BRIEF DESCRIPTION OF DRAWINGS

FIG. 5 is an explanatory drawing of the method of obtaining a current value and voltage value that are input to the inverter circuit of a fixing apparatus according to this embodiment;

FIG. 7A is an explanatory drawing of the method of obtaining a minimum power value when an image forming apparatus according to this embodiment is connected to a 100 v power source;

FIG. 7B is an explanatory drawing of the method of obtaining a minimum power value when an image forming apparatus according to this embodiment is connected to a 200 v power source;

FIG. 9A is an explanatory drawing of the method of obtaining lower limit data when an image forming apparatus according to this embodiment is connected to a 100 v power source;

FIG. 9B is an explanatory drawing of the method of obtaining lower limit data when an image forming apparatus according to this embodiment is connected to a 200 v power source;

FIG. 13 is a graph showing power variation and fixing belt temperature variation of a fixing apparatus according to this embodiment;

FIG. 14 is an explanatory drawing showing the relationship between the power source voltage and minimum power of a fixing apparatus according to this embodiment;

FIG. 15 is a graph showing belt temperature variation of the fixing belt when the process speed is 50 mm/sec and the control cycle is 50 msec according to this embodiment;

BEST MODE FOR CARRYING OUT THE INVENTION

Figure 1:
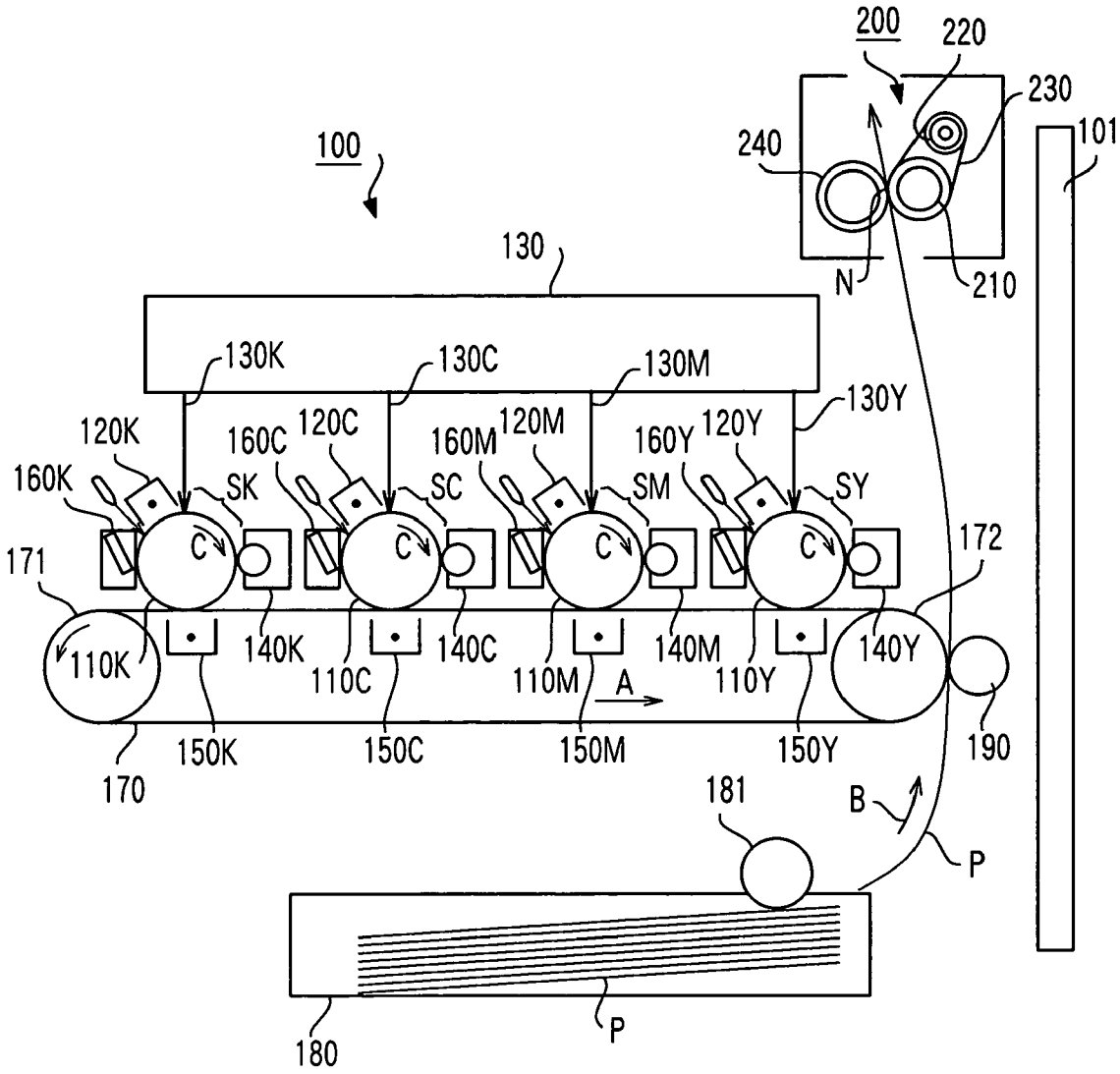
FIG. 1 is a schematic cross-sectional drawing showing the configuration of an image forming apparatus that uses an image heating apparatus according to one embodiment of the present invention as a fixing apparatus.

An embodiment of the present invention will now be described in detail with reference to the accompanying drawings. In the drawings, configuration elements and equivalent parts that have identical configurations or function are assigned the same codes, and descriptions thereof are not repeated.

FIG. 1 is a schematic cross-sectional drawing showing the configuration of an image forming apparatus that uses an image heating apparatus according to one embodiment of the present invention as a fixing apparatus. This image forming apparatus 100 is a tandem type of image forming apparatus. In image forming apparatus 100, toner images of four colors contributing to coloring of a color image are formed separately on four image bearing elements, these toner images of four colors are successively superimposed onto an intermediate transfer element as a primary transfer process, and then blanket transfer (secondary transfer) of this primary image to the recording medium is performed.

It goes without saying that that an image heating apparatus according to this embodiment is not limited to the above-described tandem type image forming apparatus, and can be installed in all types of image forming apparatus.

In FIG. 1, symbols Y, M, C, and K appended to the reference codes assigned to various configuration elements of image forming apparatus 100 indicate configuration elements involved in formation of a yellow image (Y), magenta image (M), cyan image (C), and black image (K), respectively, with configuration elements assigned the same reference code having a common configuration.

Image forming apparatus 100 has photosensitive drums 110Y, 110M, 110C, and 110K as the above-described four image bearing elements, and an intermediate transfer belt (intermediate transfer element) 170. Around photosensitive drums 110Y, 110M, 110C, and 110K are located image forming stations SY, SM, SC, and SK. Image forming stations SY, SM, SC, and SK comprise electrifiers 120Y, 120M, 120C, and 120K, an aligner (exposure apparatus) 130, developing units 140Y, 140M, 140C, and 140K, transfer units 150Y, 150M, 150C, and 150K, and cleaning apparatuses 160Y, 160M, 160C, and 160K.

In FIG. 1, photosensitive drums 110Y, 110M, 110C, and 110K are rotated in the direction indicated by arrows C. The surfaces of photosensitive drums 110Y, 110M, 110C, and 110K are uniformly charged to a predetermined potential by electrifiers 120Y, 120M, 120C, and 120K respectively.

The surfaces of charged photosensitive drums 110Y, 110M, 110C, and 110K are irradiated with laser beam scanning lines 130Y, 130M, 130C, and 130K corresponding to image data of specific colors by means of aligner 130. By this means, electrostatic latent images of the aforementioned specific colors are formed on the surfaces of photosensitive drums 110Y, 110M, 110C, and 110K.

The electrostatic latent images of each of the specific colors formed on photo sensitive drums 110Y, 110M, 110C, and 110K are developed by developing units 140Y, 140M, 140C, and 140K. By this means, unfixed images of the four colors contributing to the coloring of the color image are formed on photo sensitive drums 110Y, 110M, 110C, and 110K.

The developed toner images of four colors on photosensitive drums 110Y, 110M, 110C, and 110K undergo primary transfer to above-described endless intermediate transfer belt 170 functioning as an intermediate transfer element by means of transfer units 150Y, 150M, 150C, and 150K. By this means, the toner images of four colors formed on photosensitive drums 110Y, 110M, 110C, and 110K are successively superimposed, and a full-color image is formed on intermediate transfer belt 170.

After the toner images have been transferred to intermediate transferbelt 170, photosensitive drums 110Y, 110M, 110C, and 110K have residual toner remaining on their surfaces removed by cleaning apparatuses 160Y, 160M, 160C, and 160K, respectively.

Here, aligner 130 is provided at a predetermined angle with respect to photosensitive drums 110Y, 110M, 110C, and 110K. Also, intermediate transfer belt 170 is suspended between a drive roller 171 and idler roller 172, and is circulated in the direction indicated by arrow A in FIG. 1 by rotation of drive roller 171.

Meanwhile, at the bottom of image forming apparatus 100, a paper cassette 180 is provided in which recording paper P such as printing paper functioning as a recording medium is held. Recording paper P is fed out from paper cassette 180 by a paper feed roller 181 one sheet at a time along a predetermined sheet path in the direction indicated by arrow B.

When recording paper P fed into this sheet path passes through a transfer nip formed between the outer surface of intermediate transfer belt 170 suspended on idler roller 172 and a secondary transfer roller 190 in contact with the outer surface of intermediate transfer belt 170, the full-color image (unfixed image) formed on intermediate transfer belt 170 is blanket-transferred by secondary transfer roller 190.

Figure 2:
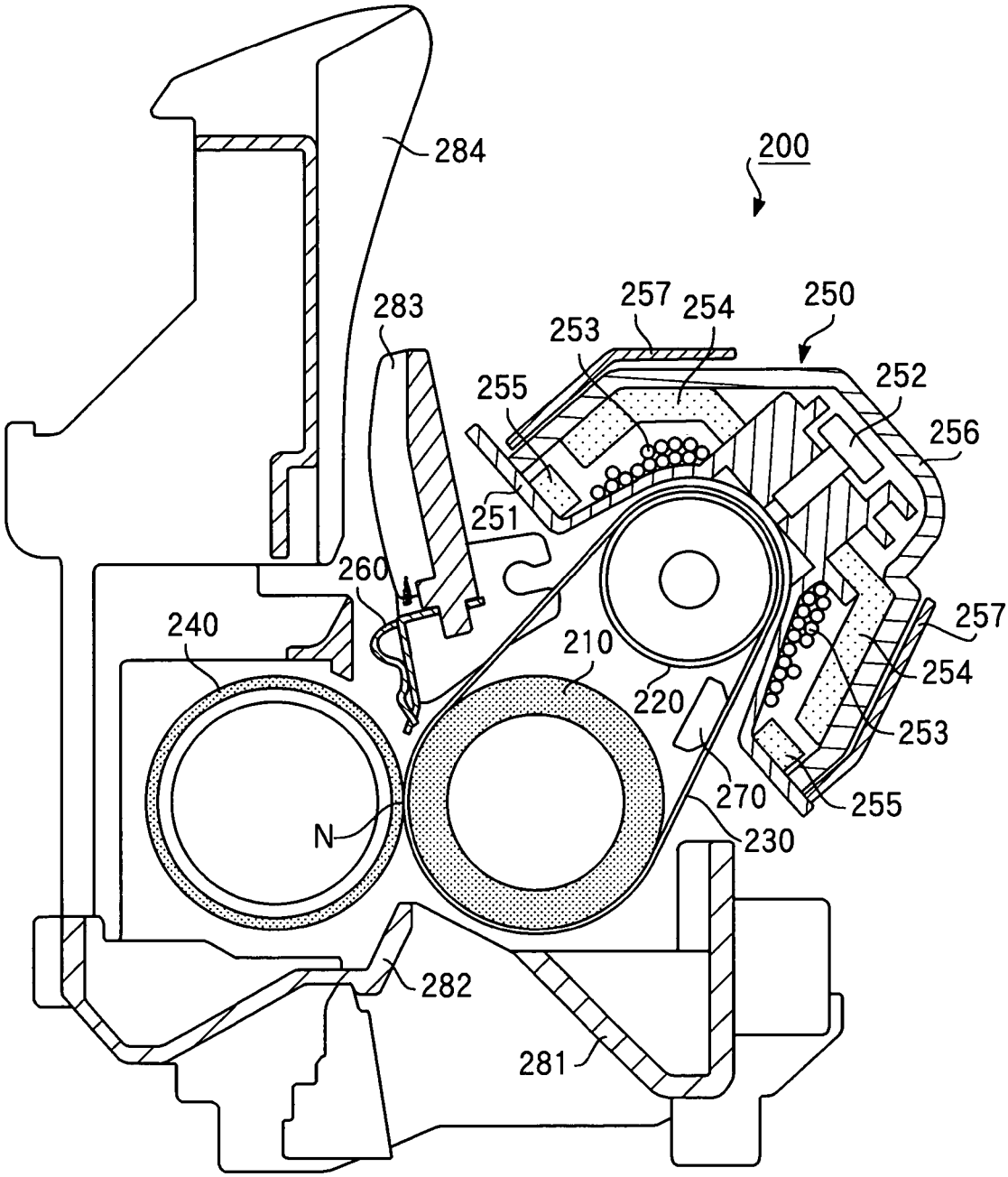
FIG. 2 is a schematic cross-sectional drawing showing the configuration of a fixing apparatus according to this embodiment.

Next, recording paper P passes through fixing nip N formed between the outer surface of a fixing belt 230 suspended between a fixing roller 210 and heat-producing roller 220, and a pressure roller 240 in contact with the outer surface of fixing belt 230, in a fixing apparatus 200 shown in detail in FIG. 2. By this means, the unfixed full-color image blanket-transferred in the transfer nip is heat-fixed onto recording paper P.

Image forming apparatus 100 is equipped with a freely opening and closing door 101 forming part of the housing of image forming apparatus 100, and replacement or maintenance of fixing apparatus 200, handling of recording paper P jammed in the above-described paper transportation path, and so forth, can be carried out by opening and closing this door 101.

Next, the fixing apparatus incorporated in image forming apparatus 100 will be described. FIG. 2 is a schematic cross-sectional drawing showing the configuration of fixing apparatus 200 that uses an image heating apparatus according to one embodiment of the present invention.

Fixing apparatus 200 uses an induction heating (IH) type of image heating apparatus as its image heating section. As shown in FIG. 2, fixing apparatus 200 is equipped with a fixing roller 210, heat-producing roller 220 as a heat-producing element, a fixing belt 230 as an image heating element, and so forth. Fixing apparatus 200 is also equipped with a pressure roller 240, an induction heating apparatus 250 as a heat-producing section, a separator 260 as a sheet separation guide plate, sheet guide plates 281, 282, 283, and 284 as sheet transportation path forming members, and so forth.

In fixing apparatus 200, heat-producing roller 220 and fixing belt 230 are heated through the working of a magnetic field generated by induction heating apparatus 250. In fixing apparatus 200, an unfixed image on recording paper P transported along sheet guide plates 281, 282, 283, and 284 is heat-fixed by fixing nip N between heated fixing belt 230 and pressure roller 240.

Fixing apparatus 200 using an image heating apparatus according to this embodiment may also be configured so that fixing belt 230 is not used, fixing roller 210 also serves as heat-producing roller 220, and an unfixed image on recording paper P is heat-fixed directly by this fixing roller 210.

In FIG. 2, heat-producing roller 220 is configured as a rotating element comprising a hollow cylindrical magnetic metallic member of iron, cobalt, nickel, or an alloy of these metals, for example. Both ends of heat-producing roller 220 are supported in rotatable fashion by bearings fixed to supporting side plates (not shown), and rotated by a drive section (not shown) Heat-producing roller 220 has a configuration enabling a rapid rise in temperature with low thermal capacity, with an external diameter of 20 mm and thickness of 0.3 mm, and is regulated so that its Curie point is 300° C. or above.

Fixing roller 210 is configured with, for example, a core of stainless steel or another metal covered by a heat-resistant elastic member of solid or foam silicone rubber. Fixing roller 210 is configured with an outer diameter of about 30 mm, larger than the outer diameter of heat-producing roller 220. The elastic member has a thickness of about 3 to 8 mm and hardness of about 15 to 50° (Asker hardness: 6 to 25° JIS A hardness).

Pressure roller 240 presses against fixing roller 210. Due to the pressure between fixing roller 210 and pressure roller 240, a fixing nip N of predetermined width is formed at the pressure location.

Fixing belt 230 is configured as a heat-resistant belt suspended between heat-producing roller 220 and fixing roller 210. Due to induction heating of heat-producing roller 220 by induction heating apparatus 250 described later herein, the heat of heat-producing roller 220 is transferred at the area of contact between this fixing belt 230 and heat-producing roller 220, and fixing belt 230 is heated all around by its circulation.

In fixing apparatus 200 with this kind of configuration, the thermal capacity of heat-producing roller 220 is smaller than the thermal capacity of fixing roller 210, and therefore heat-producing roller 220 is heated rapidly, and the warm-up time at the start of heat-fixing is shortened.

Fixing belt 230 is configured, for example, as a heat-resistant belt of multilayered construction, comprising a heat-producing layer, an elastic layer, and a release layer. The heat-producing layer uses a magnetic metal such as iron, cobalt, nickel, or the like, or an alloy of these metals, as the base material. The elastic layer is of silicone rubber, fluororubber, or the like, fitted around the surface of the heat-producing layer. The release layer is formed of resin or rubber with good release characteristics, such as PTFE (PolyTetra-Fluoro Ethylene), PFY (Per Fluoro Alkoxy Fluoroplastics), FEP (Fluorinated Etyiene Propylene copolymer), silicone rubber, fluororubber, or the like, alone or mixed.

Even if foreign matter should be introduced between fixing belt 230 configured in this way and heat-producing roller 220 for some reason, creating a gap, the fixing belt itself can still be heated by induction heating of its heat-producing layer by induction heating apparatus 250. Thus, fixing belt 230 can itself be heated directly by induction heating apparatus 250, heating efficiency is good, and response is rapid, so that there is little unevenness of temperature and reliability as a heat-fixing section is high.

Pressure roller 240 is configured with an elastic member of high heat resistance and toner releasability fitted to the surface of a core comprising a cylindrical member of a highly heat conductive metal such as copper or aluminum, for example. Apart from the above-mentioned metals, SUS may also be used for the core.

Pressure roller 240 forms fixing nip N that grips and transports recording paper P by exerting pressure on fixing roller 210 via fixing belt 230. In fixing apparatus 200 shown in the drawing, the hardness of pressure roller 240 is greater than the hardness of fixing roller 210, and fixing nip N is formed by the peripheral surface of pressure roller 240 biting into the peripheral surface of fixing roller 210 via fixing belt 230.

For this reason, pressure roller 240 has an external diameter of about 30 mm, the same as fixing roller 210, a thickness of about 2 to 5 mm, thinner than fixing roller 210, and hardness of about 20 to 60° (Asker hardness: 6 to 25° JIS A hardness), harder than fixing roller 210.

In fixing apparatus 200 with this kind of configuration, recording paper P is gripped and transported by fixing nip N so as to follow the surface shape of the peripheral surface of pressure roller 240, with the resultant effect that the heat-fixing surface of recording paper P separates easily from the surface of fixing belt 230.

A temperature detector 270 functioning as a temperature detection section comprising a thermistor or similar heat-sensitive element with high thermal responsiveness is located in direct contact with the inner peripheral surface of fixing belt 230 in the vicinity of the entry side of fixing nip N.

Induction heating apparatus 250 is controlled so that the heating temperature of heat-producing roller 220 and fixing belt 230—that is, the unfixed image fixing temperature—is maintained at a predetermined temperature based on the temperature of the inner peripheral surface of fixing belt 230 detected by temperature detector 270.

Next, the configuration of induction heating apparatus 250 will be described. As shown in FIG. 2, induction heating apparatus 250 is located so as to face the outer peripheral surface of heat-producing roller 220 via fixing belt 230. Induction heating apparatus 250 is provided with a supporting frame 251 as a coil guide member of fire-resistant resin, curved so as to cover heat-producing roller 220.

In the center part of supporting frame 251, a thermostat 252 is installed so that its temperature detecting part is partially exposed from supporting frame 251 toward heat-producing roller 220 and fixing belt 230.

If thermostat 252 detects that the temperature of heat-producing roller 220 and fixing belt 230 is abnormally high, it forcibly breaks the connection between an exciting coil 253 functioning as a magnetic field generation section wound around the outer peripheral surface of supporting frame 251 and an inverter circuit (not shown).

Exciting coil 253 is configured with a long single exciting coil wire with an insulated surface wound alternately in the axial direction of heat-producing roller 220 along supporting frame 251. The length of the wound part of this exciting coil 253 is set so as to be approximately the same as the length of the area of contact between fixing belt 230 and heat-producing roller 220.

Exciting coil 253 is connected to an inverter circuit (not shown), and generates an alternating magnetic field by being supplied with a high-frequency alternating current of 10 kHz to 1 MHz (preferably, 20 kHz to 800 kHz)This alternating magnetic field acts upon the heat-producing layers of heat-producing roller 220 and fixing belt 230 in the area of contact between heat-producing roller 220 and fixing belt 230 and its vicinity. Through the working of this alternating magnetic field, an eddy current with a direction preventing variation of the alternating magnetic field flows within the heat-producing layers of heat-producing roller 220 and fixing belt 230

This eddy current generates Joule heat corresponding to the resistance of the heat-producing roller 220 and fixing belt 230 heat-producing layers, and causes induction heating of heat-producing roller 220 and fixing belt 230 mainly in the area of contact between heat-producing roller 220 and fixing belt 230 and its vicinity.

On the other hand, an arch core 254 and side core 255 are fitted so as to surround exciting coil 253 on supporting frame 251. Arch core 254 and side core 255 increase the inductance of exciting coil 253 and provide good electromagnetic coupling of exciting coil 253 and heat-producing roller 220.

Therefore, in this fixing apparatus 200, it is possible to apply a larger amount of power to heat-producing roller 220 with the same coil current through the working of arch core 254 and side core 255, enabling the warm-up time to be shortened.

Supporting frame 251 is also provided with a resin housing 256 formed in the shape of a roof so as to cover arch core 254 and thermostat 252 inside induction heating apparatus 250. A plurality of heat release vents are formed in this housing 256, allowing heat generated by supporting frame 251, exciting coil 253, arch core 254, and so forth, to be released externally. Housing 256 may be formed of a material other than resin, such as aluminum, for example.

Supporting frame 251 is also fitted with a short ring 257 that covers the outer surface of housing 256 to prevent blockage of the heat release vents formed in housing 256. Short ring 257 is located on the rear of arch core 254. Through the generation of an eddy current in the direction in which slight leakage flux leaked externally from the rear of arch core 254 is canceled out, short ring 257 generates a magnetic field that cancels out the magnetic field of that leakage flux, and prevents unwanted emission due to that leakage flux.

Figure 3:
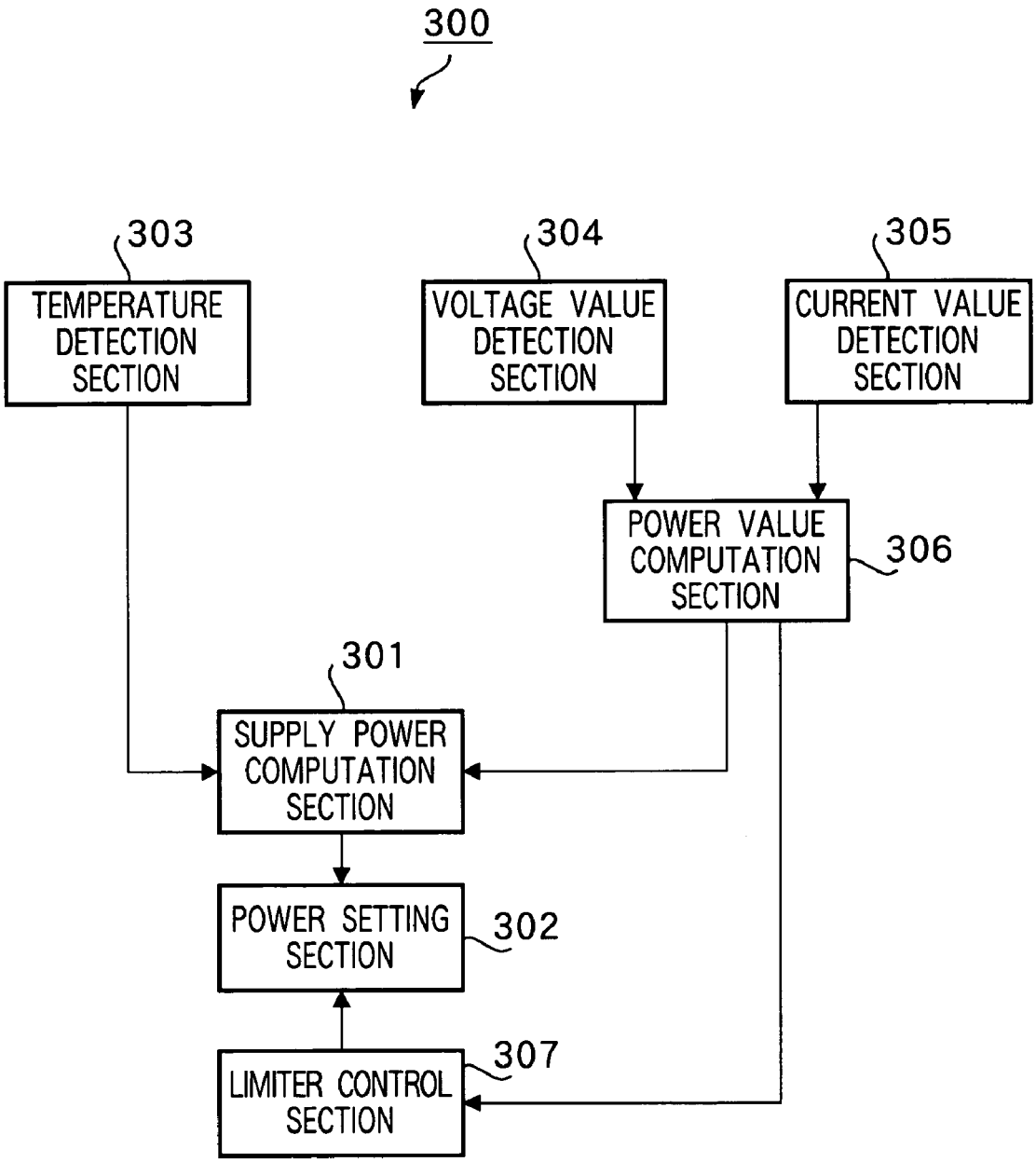
FIG. 3 is a block diagram showing the configuration of the calorific value control section of a fixing apparatus according to this embodiment.

Next, the configuration and function of the calorific value control section of fixing apparatus 200 that uses an image heating apparatus according to this embodiment will be described. FIG. 3 is a block diagram showing the configuration of the calorific value control section of fixing apparatus 200.

As shown in FIG. 3, calorific value control section 300 has a supply power computation section 301, a power setting section 302, a temperature detection section 303, a voltage value detection section 304, a current value detection section 305, a power value computation section 306, a limiter control section 307, and so forth.

When a print operation start directive is sent from a host such as a user's personal computer (not shown), image forming apparatus 100 starts an above-described image forming operation. By this means, induction heating apparatus 250 of fixing apparatus 200 heats heat-producing roller 220 and fixing belt 230 in order to heat-fix an unfixed full-color image that has undergone secondary transfer onto recording paper P by means of the above-described image forming operation.

In FIG. 3, supply power computation section 301 computes the amount of power to be supplied to induction heating apparatus 250 that heats heat-producing roller 220 and fixing belt 230 of fixing apparatus 200.

Power setting section 302 outputs power value data calculated by supply power computation section 301 to an inverter circuit (not shown) that drives exciting coil 253.

The power value output to the inverter circuit is controlled in accordance with a value (register value) set in this power setting section 302. Through control of this power value, the calorific value of induction heating apparatus 250 and the temperature of heat-producing roller 220 and fixing belt 230 for fixing an unfixed image on recording paper P are controlled.

Information necessary for performing computation of the supply power provided to induction heating apparatus 250 includes the image fixing temperature of fixing apparatus 200 and the power value actually supplied to the inverter circuit. The image fixing temperature of fixing apparatus 200 is obtained from temperature detection section 303, and the power value actually supplied to the inverter circuit is obtained from power value computation section 306.

Temperature detection section 303 converts analog output from temperature detector 270 located in contact with the inner surface of fixing belt 230 close to the entry side of fixing nip N to digital data by means of an A/D converter, and inputs the resulting data to supply power computation section 301.

Power value computation section 306 employs a method of finding the power value by multiplying together the outputs from voltage value detection section 304, which detects the input voltage value of the inverter circuit, and current value detection section 305, which detects the input current value of the inverter circuit.

Voltage value detection section 304 performs A/D conversion of the inverter circuit input voltage value and passes digital data to supply power computation section 301 Current value detection section 305 performs A/D conversion of the inverter circuit input current value and passes digital data to supply power computation section 301. With regard to the current value, it is also possible for the value of the current flowing in exciting coil 253 to be detected and used for control.

In supply power computation section 301, a computed value (register value) is set periodically (here, every 10 ms) in power setting section 302 while obtaining data from temperature detection section 303 and power value computation section 306. The temperature of heat-producing roller 220 and fixing belt 230 for fixing an unfixed image on recording paper P is controlled by having supply power computation section 301 set a computed value in power setting section 302 in this way.

Limiter control section 307 plays the role of performing a final check of the power set by power setting section 302. That is to say, if a value exceeding a predetermined stipulated limit value is set by power setting section 302, or power value computation section 306 data exceeds a predetermined stipulated value, limiter control section 307 has the function of rewriting the data set in power setting section 302 with the stipulated value.

To be more specific, if, for example, the limit value is AA (hexadecimal) HEX as data, and the value computed by supply power computation section 301 is greater than AA HEX, limiter control section 307 forcibly sets power corresponding to 80% of the target power as the value set in power setting section 302. Limiter control section 307 also performs the same kind of processing if, for example, data from power value computation section 301 is greater than 1150 W.

Actually, the above-described power is gated by an upper limit and lower limit when set, and therefore should not reach the above-described limit values. However, this kind of limit control is considered necessary in terms of providing for erroneous data detection due to noise on the lines of the A/D converters for obtaining current and voltage values.

Next, the control operation states and transition conditions of calorific value control section 300 of fixing apparatus 200 for fixing an unfixed image on recording paper P will be described.

Figure 4:
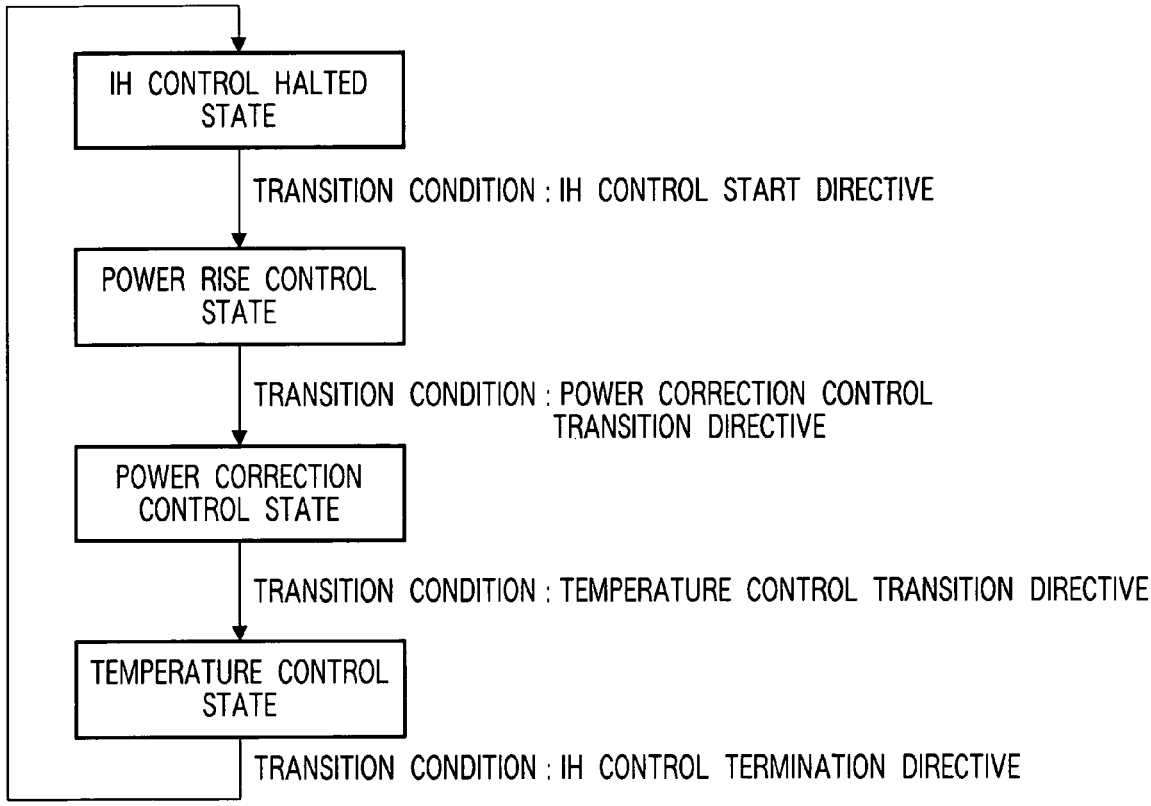
FIG. 4 is a control state transition diagram of a fixing apparatus according to this embodiment.

FIG. 4 is a control state transition diagram of calorific value control section 300 of fixing apparatus 200 that uses an image heating apparatus according to this embodiment. Here, an overview of the operation in each state of calorific value control section 300 of fixing apparatus 200 will be given. Details will be described using operation flowcharts of each state.

In FIG. 4, when image forming apparatus 100 is in a standby state such as waiting for a print request, energization of the inverter circuit is normally halted (this is hereinafter referred to as the "IH control halted state") However, with this image forming apparatus 100, to shorten the first print time, heat-producing roller 220 and fixing belt 230 of fixing apparatus 200 may be preheated to a given temperature, such as 100° C. , for example. In this case, calorific value control section 300 applies less power to the inverter circuit than the power applied to heat-fix an unfixed image to recording paper P.

When image forming apparatus 100 receives a print start directive, an inverter circuit energization start directive is issued to calorific value control section 300 of fixing apparatus 200 (this is hereinafter referred to as the "IH control start state"). By this means, the necessary preparations are performed before control is started to raise the temperature of heat-producing roller 220 and fixing belt 230 of fixing apparatus 200 to a temperature at which an unfixed image can be fixed on recording paper P (this is hereinafter referred to as the "power rise control state").

In this power rise control state, calorific value control section 300 checks whether a signal for performing energization of the inverter circuit, such as a zero-cross signal for example, is being input normally, whether the inverter circuit energization state is normal, and so forth.

The above-mentioned zero-cross signal is input to calorific value control section 300 of fixing apparatus 200 periodically as an interrupt signal, and whether or not this signal is normal is determined by measuring its cycle, high state time, and low state time.

If there is an error, such as a cycle abnormality, calorific value control section 300 halts IH control operation. If the signal is normal, calorific value control section 300 sets the data (lower limit) to be set first after the start of IH control in power setting section 302. This lower limit is a value that varies according to the power source voltage, and the minimum settable value from the standpoint of inverter circuit protection is stored as predetermined data in ROM (not shown).

After a stipulated time (here, 300 ms) following setting of the lower limit, calorific value control section 300 checks how much power is actually supplied with respect to the value set in power setting section 302 and whether or not power corresponding to the lower limit is supplied, referring to data from power value computation section 306.

For example, in the case of a 100 v power source voltage, if the lower limit data is 70 HEX (hexadecimal data) and the corresponding power is 500 W, calorific value control section 300 sets 70 HEX in power setting section 302. Then, if the data 300 ms later in power value computation section 306 is very much smaller than 500 W (here, stipulated as 200 W), a lower limit is set in power setting section 302 again, and power value computation section 306 data is checked after a stipulated time. When this retry operation has been repeated a stipulated number of times (here, 5 times) or more, calorific value control section 300 determines that there is an error and halts IH control.

If the first power application is performed normally, it is then necessary to perform second power setting. The data to be set in this second setting is decided according to how much power was actually applied with respect to the data set the first time.

For example, if the actual power is 450 W as against a theoretical value of 500 W when 70 HEX is set in power setting section 302 in the first setting, since the value is smaller than the theoretical value, a value of 80 HEX, for example, is set in power setting section 302 the second time. Conversely, if the actual power is 550 W, since the value is larger than the theoretical value, a value of 78 HEX, smaller than the above 80 HEX, is set in power setting section 302 the second time.

Power setting is repeated for power setting section 302 using the same method, and is continued until the target power is reached.

There is also a method whereby the data to be set from the second time onward is decided according to the difference between the actual power and a target power value. This target power value stipulates the maximum applicable power at a level at which the first print time can be shortened without destroying the inverter circuit.

When the actual power reaches the above-described target power after performing a number of power settings in this way, the control state switches to a state for maintaining power in the vicinity of the target power value (this is hereinafter referred to as the "power correction control state"). Here, control is performed that maintains the target power while incrementing/decrementing the power set value for power setting section 302 by one level.

Specifically, assuming the target power to be 909 W, if the actual power when 90 HEX is set in power setting section 302 is 915 W in data from power value computation section 306, 8 F HEX—a value decremented by one level—is set in set in power setting section 302 the next time.

Then, if the actual power at this time is a value lower than 909 W in the data from power value computation section 306, 90 HEX—a value obtained by incrementing 8 F HEX by one level—is set in set in power setting section 302 the next time. If the value is higher than 909 W, 8 E HEX—a value obtained by further decrementing 8 F HEX by one level—is set in set in power setting section 302.

This power correction control is continued until a temperature control transition directive is issued. The maximum set value set during this power correction control is retained as an upper limit, and is used in subsequent temperature control and so forth.

When this kind of power correction control is executed, the image fixing temperature of fixing apparatus 200 rises. When the image fixing temperature of fixing apparatus 200 reaches a stipulated temperature (here, a value 20° C. lower than the unfixed image fixing set temperature), power correction control is halted. Then, this time, a temperature control transition directive for executing temperature control (a temperature control state) based on the image fixing temperature is issued from image forming apparatus 100 to calorific value control section 300 of fixing apparatus 200.

This temperature control is performed by means of so-called PID control (described in detail later herein) in which the difference between the image fixing temperature of fixing apparatus 200 and the unfixed image fixing set temperature, the integral value thereof, and also the derivative value thereof, are used. In this PID control, a data value to be set in power setting section 302 is computed by supply power computation section 301, and a computed value is set in power setting section 302 at stipulated intervals (here, every 10 ms).

In this temperature control, unlike power control, control is carried out based on the image fixing temperature of fixing apparatus 200. Assuming that power setting section 302 is an 8-bit register, for example, the range of temperature control computation results that can be obtained is 0 to 255 (8-bit upper limit).

However, with calorific value control section 300 of fixing apparatus 200, if temperature control computation results are set directly, there is a risk of a value lower than the lower limit or higher than the upper limit being set in power setting section 302, and the inverter circuit being destroyed.

To prevent this, only values between the upper and lower limits are set in power setting section 302 when temperature control is performed. If a temperature control computation result is greater than the upper limit, the upper limit value is set in power setting section 302, and, if a temperature control computation result is less than the lower limit, the lower limit value is set in power setting section 302.

However, with calorific value control section 300 of this fixing apparatus 200, if the lower limit continues to be set, a value smaller than the lower limit is actually being requested, and there is consequently a possibility of that temperature control failing.

Thus, in calorific value control section 300 of this fixing apparatus 200, PWM control is performed according to the ratio between the lower limit and the computed value as a countermeasure to this.

Specifically, assuming a lower limit of 40 HEX, if the computed value is 20 HEX, 50% duty PWM control is performed. This series of temperature control states continues until an IH control termination directive is received by means of a print stop request or the like. Following this, fixing apparatus 200 of calorific value control section 300 switches to the IH control halted state and again enters the IH control start directive wait state.

In order for calorific value control section 300 to perform the above-described IH control, it is necessary to acquire and refer to various kinds of data already described. The method of acquiring the various kinds of data for performing the above IH control will now be described.

The following data can be mentioned as data necessary for the above-described IH control.

(1) Power source frequency (2) Current value and voltage value input to the inverter circuit, and the power value obtained by multiplying these (3) Target power value (4) Minimum power value (5) Limit power value (6) Lower limit register value (7) Limit value register value (8) Fixing apparatus temperature (plurality of locations)

The above-mentioned upper limit is found when power correction control is executed, and will be covered in the description of power correction control operation later herein.

First, the method of measuring item (1)—power source frequency—will be described. When image forming apparatus 100 is powered on, zero-cross signal input is started. This zero-cross signal is sent to calorific value control section 300 as a CPU (central processing unit) (not shown) interrupt signal.

Normally, an interrupt disabling/interrupt enabling specification can be made for CPU interrupts, and interrupts are disabled when power is turned on. Thus, with this image forming apparatus 100, interrupts are enabled and zero-cross signal input to calorific value control section 300 is made possible by making an interrupt enabling specification after powering on.

Calorific value control section 300 starts a timer when a zero-cross signal is input, and measures the time until the next zero-cross signal input—that is, interrupt generation. Calorific value control section 300 determines the power source frequency (50 Hz/60 Hz) from this measured time. The zero-cross cycle is 20 ms at 50 Hz, and 16.7 ms at 60 Hz. Thus, in calorific value control section 300 of this fixing apparatus 200, taking interrupt generation time delay and variation into consideration, 18 ms is taken as a threshold value, with 50 Hz stipulated for this value and above, and 60 Hz below this value.

Next, the method of obtaining item (2)—current value and voltage value input to the inverter circuit, and the power value obtained by power value computation section 306 by multiplying these—will be described. FIG. 5 is an explanatory drawing of the method of obtaining a current value and voltage value implemented by power value computation section 306.

As shown in FIG. 5, the actual current value and voltage value acquisition and computation equations vary according to the power source voltage system and power source frequency. The power source voltage system here is reported to calorific value control section 300 after detection by a low-voltage power source (not shown) of whether image forming apparatus 100 is connected to a 100 v power source or a 200 v power source.

As shown in FIG. 5, the actual current value Ival input to the inverter circuit and A/D converted digital data ADi have a linear equation relationship, and their factors are found empirically. The actual voltage value Vval input to the inverter circuit and A/D converted digital data ADv similarly have a linear equation relationship, and their factors are also found empirically.

For example, the voltage value input to the inverter circuit at 100 v and 50 Hz is found as follows:

$$Vval=0.7112\times ADv-33.0290 \text{ [volt]} \qquad \text{Equation 5-1}$$

The current value input to the inverter circuit at 100 v and 50 Hz is found as follows:

$$Ival=0.0533\times ADi-1.5059 \text{ [amp]} \qquad \text{Equation 5-2}$$

The voltage value input to the inverter circuit at 100 v and 60 Hz is found as follows:

$$Vval=0.7148\times ADv-33.1930 \text{ [volt]} \qquad \text{Equation 5-3}$$

The current value input to the inverter circuit at 100 v and 60 Hz is found as follows:

$$Ival=0.0535\times ADi-1.6145\ [amp] \quad \text{Equation 5-4}$$

The voltage value input to the inverter circuit at 200 v and 50 Hz is found as follows:

$$Vval=1.4048\times ADv-63.7730\ [volt] \quad \text{Equation 5-5}$$

The current value input to the inverter circuit at 200 v and 50 Hz is found as follows:

$$Ival=0.0269\times ADi-0.8516\ [amp] \quad \text{Equation 5-6}$$

The voltage value input to the inverter circuit at 200 v and 60 Hz is found as follows:

$$Vval=1.4048\times ADv-63.7730\ [volt] \quad \text{Equation 5-7}$$

The current value input to the inverter circuit at 200 v and 60 Hz is found as follows:

$$Ival=0.0268\times ADi-0.9182\ [amp] \quad \text{Equation 5-8}$$

The power value supplied to the inverter circuit is calculated by multiplying together the current value and voltage value calculated from the above equations in power value computation section 306. With this fixing apparatus 200, voltage fluctuations and so forth can be handled in real time by repeating these computations by power value computation section 306 every 10 ms, providing more reliable IH control.

Next, the method of obtaining item (3)—target power value—implemented by calorific value control section 300 will be described. This target power value is set from the standpoint of shortening the first print time—an image forming apparatus 100 performance item—and protecting the inverter circuit.

That is to say, with this image forming apparatus 100, increasing the target power value is advantageous in terms of first print time, but may incur a risk of destruction of the inverter circuit. Conversely, decreasing the target power value is desirable from the standpoint of protecting the inverter circuit, but may slow down the first print time. Thus, this target power value is decided upon empirically based on a trade-off between the above two considerations.

Figure 6A:
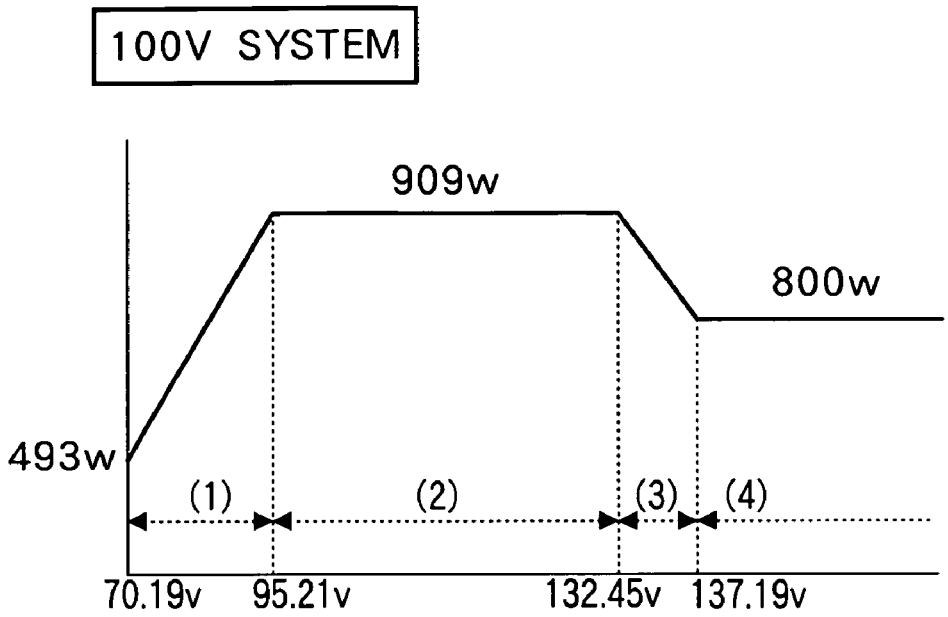
FIG. 6A is an explanatory drawing of the method of obtaining a target power value when an image forming apparatus according to this embodiment is connected to a 100 v power source.
Figure 6B:
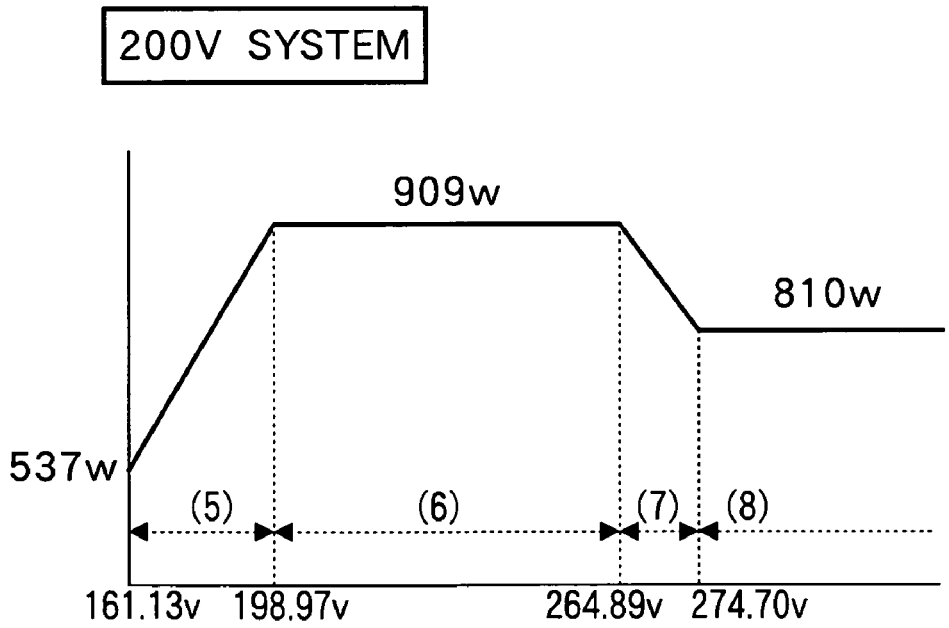
FIG. 6B is an explanatory drawing of the method of obtaining a target power value when an image forming apparatus according to this embodiment is connected to a 200 v power source.

FIG. 6A and FIG. 6B are explanatory drawings of the method of obtaining the target power value implemented by calorific value control section 300.

FIG. 6A shows a case where image forming apparatus 100 is connected to a 100 V power source.

The target power value of section (1) (power source voltage from 70.19 v to 95.21 v) is found as follows:

$$16.39\times \text{power source voltage}-651.1960\ [W] \quad \text{Equation 6-1}$$

The target power value of section (2) (power source voltage of over 95.21 v and less than 132.45 v) is fixed as follows:

$$909\ [W] \quad \text{Equation 6-2}$$

The target power value of section (3) (power source voltage of 132.45 v to 137.19 v) is found as follows:

$$-22.94\times \text{power source voltage}+3947.1190\ [W] \quad \text{Equation 6-3}$$

The target power value of section (4) (power source voltage of over 137.19 v) is fixed as follows:

$$800\ [W] \quad \text{Equation 6-4}$$

In this section (4), the minimum power described later herein is also the same value.

FIG. 6B shows a case where image forming apparatus 100 is connected to a 200 V power source.

The target power value of section (5) (power source voltage from 161.13 v to 198.97 v) is found as follows:

$$9.83\times \text{power source voltage}-1047.0476\ [W] \quad \text{Equation 6-5}$$

The target power value of section (6) (power source voltage of over 198.97 v and less than 264.89 v) is fixed as follows:

$$909\ [W] \quad \text{Equation 6-6}$$

The target power value of section (7) (power source voltage of 264.89 v to 274.70 v) is found as follows:

$$-9.84\times \text{power source voltage}+3513.0034\ [W] \quad \text{Equation 6-7}$$

The target power value of section (8) (power source voltage of over 274.70 v) is fixed as follows:

$$810\ [W] \quad \text{Equation 6-8}$$

In this section (8), the minimum power described later herein is also the same value.

Thus, with this image forming apparatus 100, from the standpoint of protecting the inverter circuit, or from the standpoint of maintaining the first print time, an appropriate target power value is set every voltage Thus, with calorific value control section 300 of this image forming apparatus 100, voltage fluctuations and so forth can be handled in real time by acquiring a target power value every 10 ms, achieving more reliable IH control.

Next, the method of obtaining item (4)—minimum power value—will be described. This minimum power value is set from the standpoint of inverter circuit protection. As explained above, if high power, or power less than a certain value, is supplied to the inverter circuit, there is a possibility that the inverter circuit will be destroyed.

FIG. 7A and FIG. 7B are explanatory drawings of the method of obtaining a minimum power value in this calorific value control section 300. As shown in FIG. 7A (100 v system) and FIG. 7B (200 v system), the minimum power value varies according to the power source voltage. Calorific value control section 300 can handle voltage fluctuations and so forth in real time by acquiring a minimum power value every 10 ms, providing more reliable IH control.

A smaller minimum power value provides better control performance—that is to say, a wider control dynamic range and better controllability—in fixing apparatus 200 temperature control, but on the other hand increases the risk of inverter circuit destruction. Thus, this minimum power value is decided upon empirically based on a trade-off between the above two considerations, in the same way as the target power described earlier.

Next, the method of obtaining item (5)—limit power value—will be described. This limit power value is stipulated as a power value of target power+250 W.

As the image fixing temperature of fixing apparatus 200 is normally power-controlled with the above-described target power value, the power supplied to the inverter circuit should never reach the limit power. This limit power value is provided to insure against disturbed operation, such as when calorific value control section 300 malfunctions due to noise or the like, or current value or voltage value A/D converted data values are abnormal.

That is to say, if it is detected that the power supplied to the inverter circuit is greater than the limit power, calorific value control section 300 controls the power set value so that the supply power becomes a value smaller than the target power (for example, a power value that is 80% of the target power). By this means, it is possible to prevent IH control problems due to inverter circuit breakdown or malfunction.

Figure 8A:
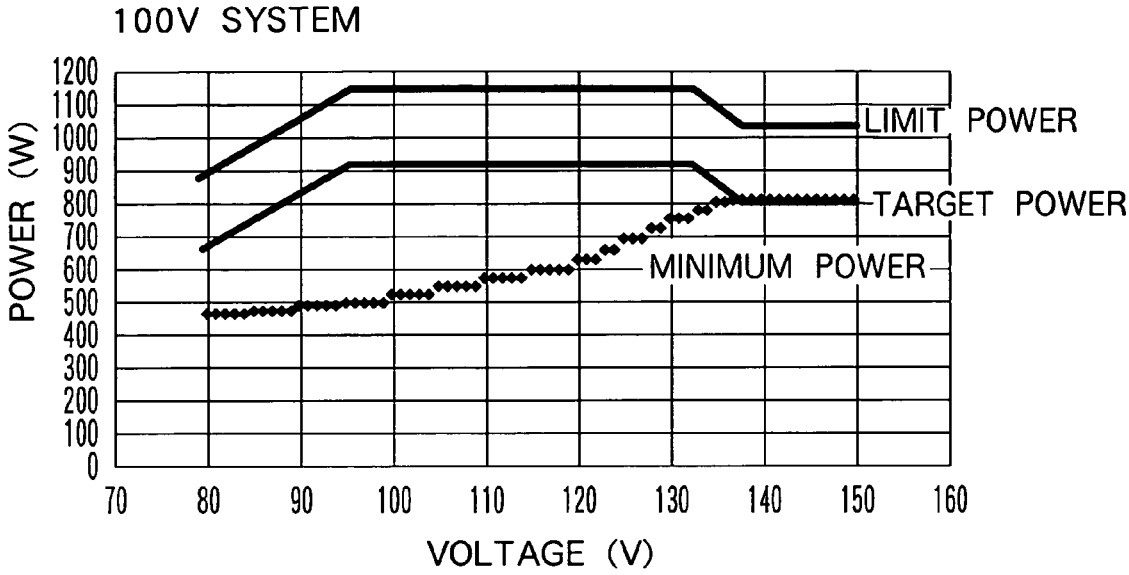
FIG. 8A is a relational diagram showing the relationship between the target power value, minimum power value, and limit power value when an image forming apparatus according to this embodiment is connected to a 100 v power source.
Figure 8B:
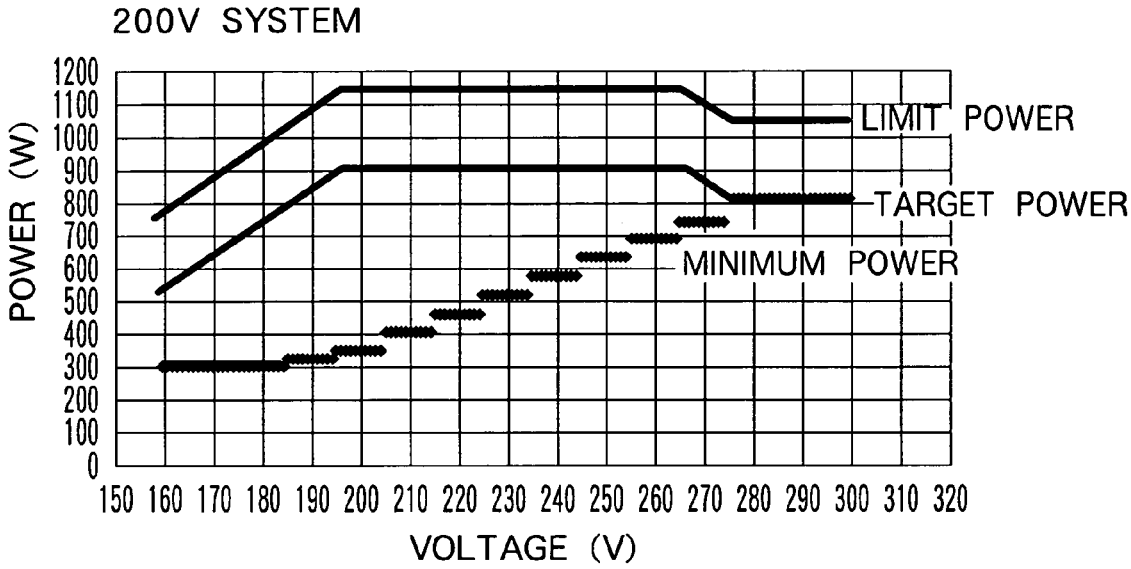
FIG. 8B is a relational diagram showing the relationship between the target power value, minimum power value, and limit power value when an image forming apparatus according to this embodiment is connected to a 200 v power source.

FIG. 8A and FIG. 8B are relational diagrams showing the relationship between the target power value, minimum power value, and limit power value in 100 v and 200 v systems. As shown in FIGS. 8A and 8B, the limit power is set as target power+250 [W] for both 100 v and 200 v systems. In FIGS. 8A and 8B, the minimum power values shown in FIG. 7 are plotted on the graphs.

Next, the method of obtaining item (6)—lower limit register value—implemented by calorific value control section 300 will be described. FIG. 9A and FIG. 9B are explanatory drawings of the method of obtaining lower limit data in 100 v and 200 v systems. Lower limit data comprises register values corresponding to above-described minimum power values. For example, as shown in FIG. 7, this lower limit data is 525 W minimum power in the case of a 100 v power source voltage.

On the other hand, lower limit data in the case of a 100 v power source voltage is calculated as 77 (decimal) by means of Equation 9-6 shown in FIG. 9A. This register value, not the power value (watt indication) shown in FIG. 7, is used in actual IH control.

Lower limit data and power values (number of watts) are uniquely decided, but some variation may arise due to variation of the inductance of exciting coil 253 and fixing apparatus 200, change over time through actual use, and so forth.

Thus, with this fixing apparatus 200, after power setting in each phase of IH control including lower limit data, calorific value control section 300 constantly feeds back power from the current value and voltage value input to the inverter circuit. By this means, this fixing apparatus 200 eliminates the causes of variations and implements more reliable IH control.

A lower limit register value varies according to the power source voltage, and is found from a second-order relational equation involving the power source voltage. A factor of this second-order relational equation is found empirically taking account of variation of the inductance of fixing apparatus 200 and exciting coil 253.

Specifically, a factor is found by taking data with maximum value and minimum value items in the parts spec of fixing apparatus 200 and exciting coil 253, and also an item in the vicinity of the average value. With this fixing apparatus 200, more reliable IH control is implemented that enables voltage fluctuations and so forth to be handled in real time by repeating lower limit register value acquisition every 10 ms.

Next, the method of obtaining item (7)—limit value register value—implemented by calorific value control section 300 will be described. For this limit value register value, the same kind of experimentation is performed on the minimum power value as the experimentation for obtaining lower limit data, and register data corresponding to the limit power value is found.

With fixing apparatus 200, data is normally limited by an upper limit in power setting during IH control, and therefore a power set value should never reach the limit value. However, an upper limit found during power correction control, for example, may exceed the limit value due to variation of the inductance of exciting coil 253 and fixing apparatus 200, change over time through actual use, and so forth, as described above.

That is to say, in calorific value control section 300 of this fixing apparatus 200, a power setting that should reach the target power is successively incremented during power correction control. However, if the inductance of exciting coil 253 or fixing apparatus 200 has deviated from the parts spec value due to change over time or the like, a state will be entered in which the target value will not be reached however large the power set value is made—that is, a state in which it is difficult for power to be input—and the power set value will be incremented perpetually.

Since this kind of power set value incrementing is undesirable from the standpoint of inverter circuit protection, it is necessary for a final limit value to be set in advance. Thus, if the power set value exceeds the limit value, calorific value control section 300 controls the power set value so that the supply power becomes a value smaller than the target power (for example, a power value that is 80% of the target power). By this means, it is possible to prevent IH control problems due to inverter circuit breakdown or malfunction. With calorific value control section 300 of this fixing apparatus 200, more reliable IH control is implemented that enables voltage fluctuations and so forth to be handled in real time by repeating limit value register value acquisition every 10 ms.

Next, the method of obtaining item (8)—fixing apparatus temperature—implemented by temperature detection section 303 will be described. In this fixing apparatus 200, this temperature is detected at two locations by above-described temperature detectors 270.One is the center of fixing apparatus 200, and the other is the end of fixing apparatus 200.The purpose of temperature detection in the center of fixing apparatus 200 is to fix an unfixed image on recording paper P at the optimal image fixing temperature, and ensure image quality. The purpose of temperature detection at the end of fixing apparatus 200 is to detect an abnormal rise in temperature of the paper non-pass (end section) of fixing apparatus 200 when small-size paper is printed continuously, and perform cooling-down.

The detected temperatures of temperature detectors 270 that detect the temperatures of these parts of fixing apparatus 200 are passed through an A/D converter in temperature detection section 303 and undergo data acquisition, and are passed to supply power computation section 301 as digital data. Acquisition of fixing apparatus 200 temperature data by temperature detection section 303 is performed every 10 ms, and is used for temperature control computation and fixing apparatus 200 error detection.

Figure 10:
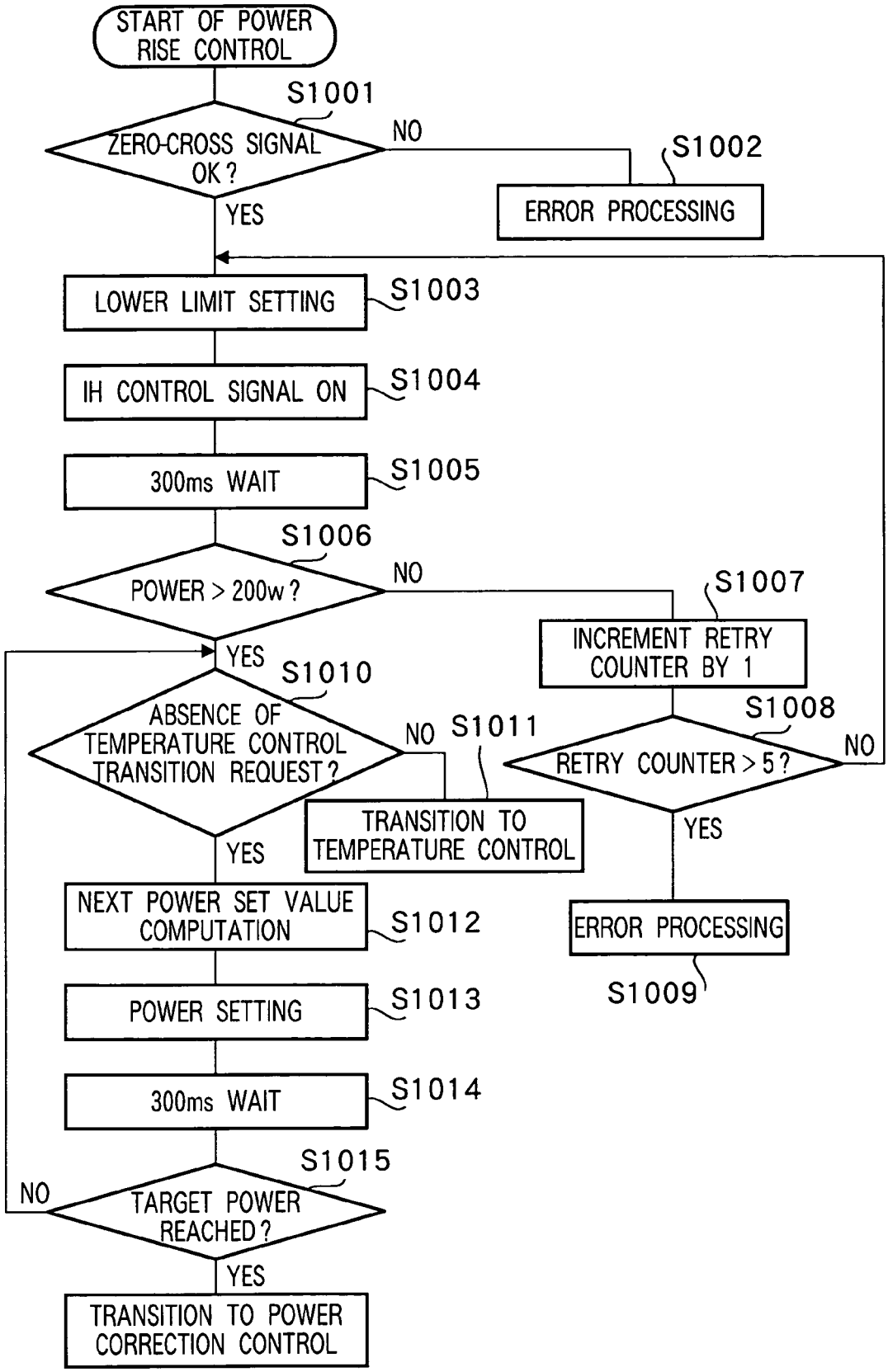
FIG. 10 is a flowchart of operation in the power rise control state of a fixing apparatus according to this embodiment.

Next, the IH control method at the time of a fixing apparatus 200 power rise will be described. FIG. 10 is a flowchart of operation in the fixing apparatus 200 power rise control state.

On receiving a print request from an external PC (personal computer) or the like, image forming apparatus 100 starts fixing apparatus 200 heating control—so-called IH control—for fixing the unfixed image onto recording paper P.

In this IH control, calorific value control section 300 first performs power rise control. In this phase, as described above, preparatory processing is performed for raising the temperature of heat-producing roller 220 and fixing belt 230 of fixing apparatus 200 until a temperature is reached at which fixing of the unfixed image onto recording paper P is possible. In this phase, also, preparations are made for various kinds of data acquisition in order to perform IH control.

Acquisition of data comprising the input voltage to the inverter circuit, the in-circuit input current, the power source voltage frequency, and the temperature of fixing apparatus 200 is performed from the time of powering on of image forming apparatus 100.

The input voltage to the inverter circuit passes through an A/D converter in voltage value detection section 304, is stored temporarily in a work memory (not shown) as digital data, and is passed to power value computation section 306. The input current to the inverter circuit passes through an A/D converter in current value detection section 305, is stored temporarily in a work memory (not shown) as digital data, and is passed to power value computation section 306. Then the power value supplied to the inverter circuit is calculated by multiplying together this voltage value and current value in power value computation section 306.

Calorific value control section 300 of fixing apparatus 200 is configured so that these data acquisition and computational operations are executed every 10 ms, and any power source voltage fluctuations that may occur can be handled in real time. The acquired voltage values are variable parameters for varying the minimum power value (watts), target power value (watts), lower limit (register value), and limit value (register value) described later herein.

With regard to power source voltage frequency, a zero-cross signal is input as an interrupt signal to the CPU (not shown) in calorific value control section 300 that performs fixing apparatus 200 main control from the time of powering on, and the power source voltage frequency is measured by measuring the generation cycle of this interrupt signal.

With regard to the temperature of fixing apparatus 200, analog output from temperature detector 270 comprising a heat-sensitive element with high thermal responsiveness such as a thermistor passes through an A/D converter in temperature detection section 303 and is input to supply power computation section 301 as digital data.

Calorific value control section 300 of fixing apparatus 200 is configured so that these operations are executed repeatedly every 10 ms, and fixing apparatus 200 temperature variations can be handled in real time.

In FIG. 10, when IH control is started by calorific value control section 300, a zero-cross signal check is first performed (step S1001). This check is to confirm whether or not the zero-cross signal is being input, and does not include a detailed cycle check.

Since the cycle is approximately 20 ms if the power source frequency is 50 Hz, and approximately 16.7 ms if the power source frequency is 60 Hz, if the zero-cross signal is normal a zero-cross interrupt is issued to the CPU of calorific value control section 300 at these intervals.

A case in which a zero-cross interrupt fails to be generated for a continuous period of more than one second is stipulated as an error condition in this example, and if this state occurs, image forming apparatus 100 operation is halted as an error response (step S1002).

If, on the other hand, the zero-cross signal is confirmed as being normal in step S1001, calorific value control section 300 next performs lower limit setting (step S1003). This lower limit value (register value) is a value corresponding to the minimum power.

Then, the IH control signal is turned on (step S1004), and a fixing apparatus 200 heating operation is started by calorific value control section 300.After the IH control signal is turned on, calorific value control section 300 waits for 300 ms (step S1005). This is the time until power is set in power setting section 302 and power is actually applied to the inverter circuit.

This wait time varies according to the configuration of the inverter circuit.

In this example, a 300 ms wait time is secured. This 300 ms wait time is a time in the direction in which power is incremented. In the direction in which power is decremented, on the other hand, a 1500 ms wait time is provided. This wait time in the power decrementing direction also depends on the configuration of the inverter circuit.

Following the elapse of 300 ms after this IH control signal is turned on, calorific value control section 300 carries out a check of the power being applied to the inverter circuit (step S1006). This check is performed using the power value obtained by multiplying together the above-described current value and voltage value input to the inverter circuit in power value computation section 306.

When the lower limit is set, although there is variation, change over time, and the like, of the inductance of the IH coil and fixing apparatus 200, approximately the minimum power value is returned as the power applied to the inverter circuit. This minimum power value differs according to the power source voltage and the voltage input to the inverter circuit, but, as shown in FIG. 7, is a minimum of 300 W at less than 185 v in a 200 v system.

Taking this into consideration, calorific value control section 300 performs error processing for excessively low power if the power is 200 W or less, independent of the inverter circuit input voltage. However, IH control is not stopped immediately at this point as a service call error, but, instead, power setting and power check retry operations are performed. IH control is halted as a service call error, and overall operation of image forming apparatus 100 is halted, when calorific value control section 300 has executed the stipulated number of retry operations or more.

Specifically, if power is found to be 200 W or less in a power check by calorific value control section 300, a retry counter (reset to 0 at the start of IH control) is incremented by 1 (step S1007). Then calorific value control section 300 checks whether or not the retry counter value is greater than 5—that is, whether or not the number of retries has exceeded 5 (step S1008). If the number of retries has not exceeded 5, the processing flow returns to step S1003, and a power setting operation is repeated by calorific value control section 300.If the number of retries has exceeded 5, calorific value control section 300 halts IH control as a service call error, and halts overall operation of image forming apparatus 100 (step S1009).

When it is confirmed that power is being applied normally in this way, calorific value control section 300 next checks whether or not there is a temperature control transition request (step S1010). This is determined from the output of temperature detection section 303 that detects the temperature of fixing apparatus 200. As described above, in this example, thermistors constituting temperature detection section 303 are provided at two locations, the center and end of fixing apparatus 200, but it is the center thermistor that is used for this fixing apparatus 200 temperature control.

This temperature control transition request is issued by calorific value control section 300 when a temperature 20° C. lower than the set temperature for fixing an unfixed image onto recording paper P is reached (the temperature depending on the process speed, type of recording medium, environmental conditions, and so forth) (step S1011). For example, if the fixing set temperature is 170° C. , a temperature control transition request is issued when the temperature of fixing apparatus 200 reaches 150° C.

After the start of IH control, the temperature of fixing apparatus 200 is normally low, and therefore a transition to temperature control is seldom made at this time. However, in intermittent printing with a short wait time or the like, printing is started with fixing apparatus 200 fully warmed up from the previous printing session, and therefore a transition to temperature control is often made immediately after a power check.

If there is no temperature control transition request following this power check, supply power computation section 301 performs computation of the power value that should be set next time (step S1012). The power set value to be set next time is calculated based on a calculation equation (not shown) determined beforehand from the difference or ratio between the power value detected (computed) 300 ms after the lower limit was set previously and the minimum power value corresponding to the inverter circuit input voltage at that time.

This power set value corresponds to the above-described target power value. For example, if, when the minimum power value is 500 W, the lower limit is set and the power value actually returned is 400 W, the next set value will be set higher since the actual value is lower than the theoretical value. Conversely, if 600 W is returned, the next set value will be set lower since the actual value is higher than the theoretical value.

After the power set value computed by supply power computation section 301 in this way is actually set (step S1013) and a 300 ms wait period has elapsed (step S1014), calorific value control section 300 checks whether or not the target power has been reached (step S1015). If the target power has not been reached at this point, calorific value control section 300 returns to step S1010 and repeats the processing from there on. On the other hand, if the target power has been reached, calorific value control section 300 terminates power rise control and switches to power correction control.

Figure 11:
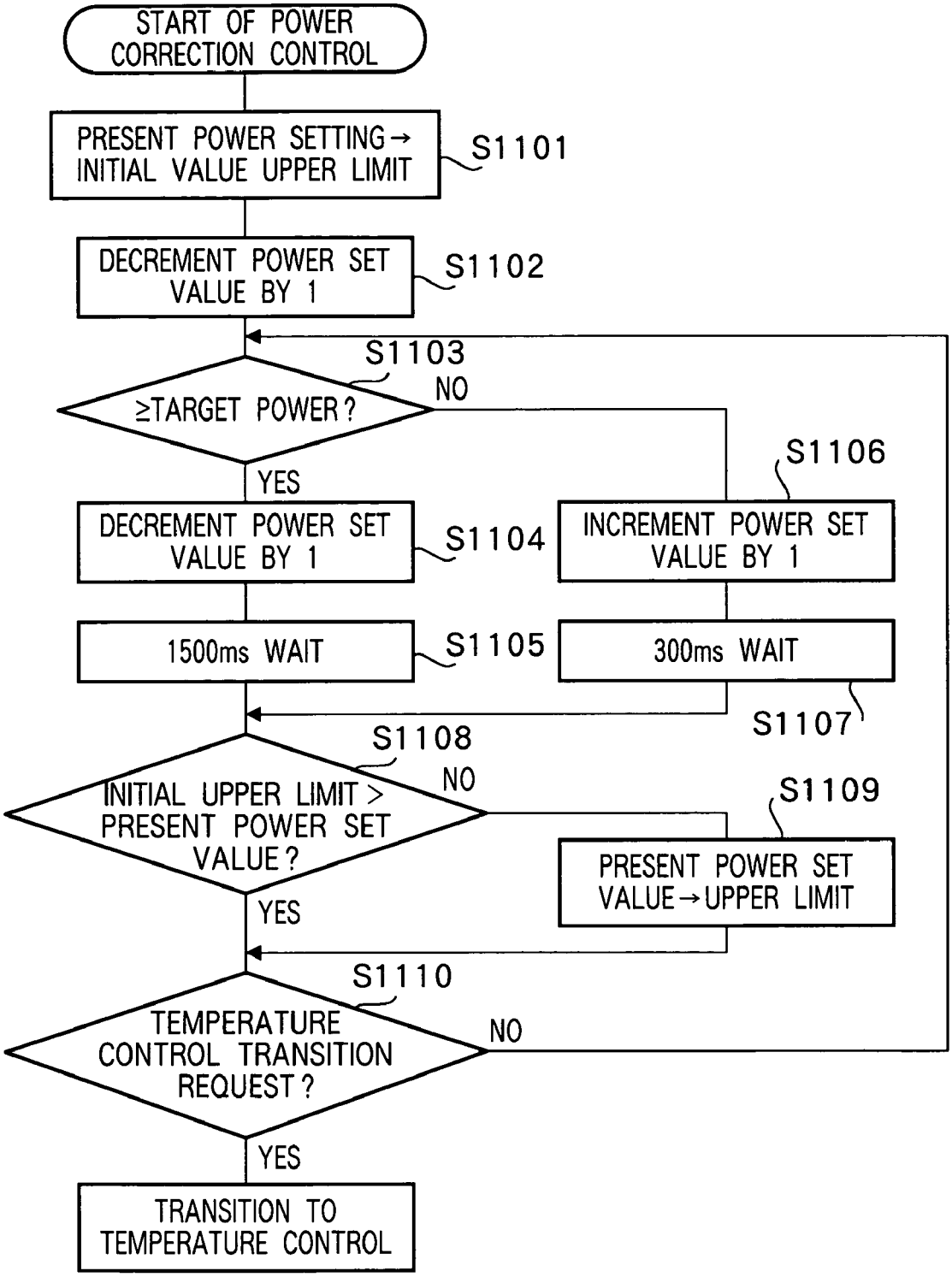
FIG. 11 is a flowchart of operation in the power correction control state of a fixing apparatus according to this embodiment.

Next, the IH control method at the time of power correction control will be described. FIG. 11 is a flowchart of operation in the fixing apparatus 200 power correction control state.

As shown in FIG. 11, during power correction control, calorific value control section 300 first takes the power set value immediately after transiting to power correction control from power rise control as an upper limit, and stores this temporarily in a work area (not shown) (step S1101). This upper limit is used as the upper limit when performing subsequent temperature control computation.

Also, as described above, a predetermined stipulated value (in this example, a power set value equivalent to approximately 80% of the target value) is used as an upper limit when a transition is made to temperature control during power rise control.

In this power correction control state, the amount of variation of the power set value is at the +1/−1 level. That is to say, in this power correction control, supply power computation section 301 performs power correction control by decrementing the power set value by 1 when the target value is exceeded, and incrementing the power set value by 1 when the target value is not reached. Immediately after a transition from power rise control to power correction control, the target power is exceeded, and supply power computation section 301 decrements the power set value by 1 (step S1102).

Following this, supply power computation section 301 performs a check of the power passed from power value computation section 306 (step S1103), and if the power value is greater than or equal to the target power, decrements the power set value by 1 (step S1104), and waits for 1500 ms (step S1105). If the power value is less than the target power value, supply power computation section 301 increments the power set value by 1 (step S1106), and waits for 300 ms (step S1107).

During this power correction control, supply power computation section 301 performs a size comparison of power set values obtained by performing incrementing or decrementing by 1 while referencing the upper limit stored in the work area immediately after transiting from power rise control to power correction control and the target power (step S1108).

If the power set value during power correction control exceeds the upper limit stored in the work area, supply power computation section 301 updates the value taking that value as the new upper limit (step S1109). Supply power computation section 301 then carries out a temperature control transition request check (step S1110), and, if there is no request, returns to step S1103 and repeats the processing.

Details concerning a temperature control transition request are the same as in the description of power rise control, and will be omitted here. If there is a temperature control transition request, a transition is made to temperature control.

Figure 12:
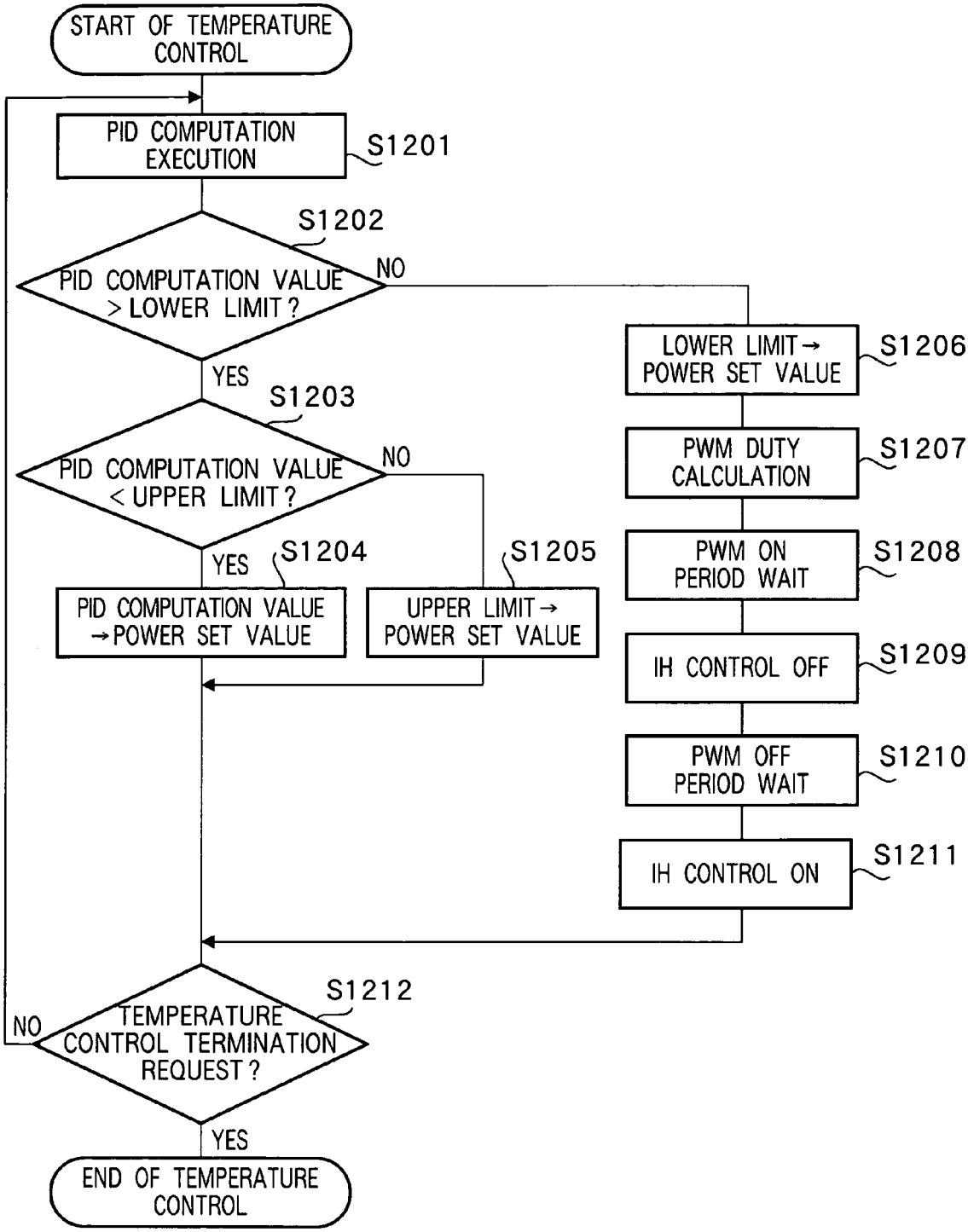
FIG. 12 is a flowchart of operation in the temperature control state of a fixing apparatus according to this embodiment.

Next, the IH control method at the time of temperature control will be described in detail. FIG. 12 is a flowchart of operation in the fixing apparatus 200 temperature control state.

The reference value for computing a power set value in above-described power rise control and power correction control is a power value calculated by power value computation section 306 from the inverter circuit input current value and power value. In contrast, the reference value for computing a power set value in the case of this temperature control is the output of a thermistor (temperature detection section 303) in the central part of fixing apparatus 200—that is, the temperature of the central part of fixing apparatus 200.

The computation method used to find the power set value implemented by supply power computation section 301 is PID computation that computes a power set value in accordance with the difference between the fixing set temperature for fixing an unfixed image onto recording paper P (which depends on the process speed, type of recording medium, environmental conditions, and so forth) and the actual temperature of the central part of fixing apparatus 200 (step S1201).

Although not shown in the drawing, supply power computation section 301 begins a check of the thermistor at the end part of fixing apparatus 200 from the point at which a transition is made to this temperature control, and halts IH control on an error basis if the difference between the temperature of the central part of fixing apparatus 200 and the temperature of the end part of fixing apparatus 200 is greater than or equal to a stipulated value.

In this example, this stipulated temperature is set at 30° C. That is to say, an error is identified if the temperature of the end part of fixing apparatus 200 is at least 30° C. lower than the temperature of the central part of fixing apparatus 200 from the point in time at which the temperature of the central part of fixing apparatus 200 reaches a temperature 20° C. less than the fixing set temperature (transits to temperature control).

In PID computation, a power set value is calculated according to the difference between the unfixed image fixing set temperature in accordance with the process speed, type of recording paper, environmental conditions, and so forth (hereinafter referred to simply as "fixing set temperature") and the output of the thermistor in the central part of fixing apparatus 200 (hereinafter referred to simply as "fixing apparatus temperature") (this difference being referred to hereinafter as "deviation"). Also, in PID computation, a power set value is calculated according to the accumulated value of deviations (hereinafter referred to as "integral value"), and also the difference between the previous difference and the present difference (hereinafter referred to as "derivative value"). In this example, PID control is used in which the power set value is calculated by multiplying the deviation and its integral value by a certain fixed coefficient. The PID control computational equation is as shown in Equation 12-1 below.

$$\text{Power set value}=Kp\{E(n)+Kt\times\Sigma E(n)\} \qquad \text{Equation 12-1}$$

where Kp=proportional constant, Kt=integral constant, and E(n)=deviation

Here, proportional constant Kp and integral constant Kt are calculated using a threshold sensitivity method (not shown) which is a known method of finding these values. Then the final coefficient is decided upon after fine value adjustment so that the first overshoot when the set temperature is first reached and temperature ripple in steady-state control are within a permissible range, taking control system characteristics (in this example, inductance variation of fixing apparatus 200 and exciting coil 253, and so forth) into consideration. OThe temperature control sampling cycle in this example is 10 ms, and a power set value is calculated in accordance with the Equation 12-1 control rule using this cycle.

If a value computed by means of the above-described PID computation is applied directly to the inverter circuit as a power set value, a value that exceeds the above-described upper limit or limit value or is less than the lower limit will be output. In this case, a major problem may occur from the standpoint of inverter circuit protection, with a possible worst-case scenario of destruction of the inverter circuit.

In order to prevent this, in this temperature control, inverter circuit protection is achieved by performing power setting while constantly comparing the above-described PID computation value and the upper limit and lower limit already calculated or predetermined in this temperature control phase.

That is to say, in this temperature control, supply power computation section 301 compares the relative sizes of the PID computation value and the lower limit (step S1202). If PID computation value>lower limit, the comparative sizes of the PID computation value and upper limit are then compared (step S1203). If PID computation value<upper limit, supply power computation section 301 sets the PID computation value as the power set value (step S1204).

If the PID computation value exceeds the upper limit, supply power computation section 301 sets the upper limit as the power set value (step S1205) The processing flow then proceeds to a temperature control termination request check (step S1212).

A description will now be given of temperature control when the PID computation value is lower than the lower limit in step S1202. This is the processing from step S1206 through step S1211 in FIG. 12. There is no problem if the PID computation value can be set directly as the power set value, but as explained above, there are limits to the power set value for reasons of inverter circuit protection.

A state in which the PID computation value exceeds the upper limit occurs immediately after a transition from power correction control to temperature control, and this state is unlikely to occur during steady-state temperature control. However, a case in which the PID computation value is lower than the lower limit, on the other hand, occurs frequently when fixing apparatus 200 has warmed up and requires only low power.

When the PID computation value is lower than the lower limit in this way, if the power set value continues to be set at the lower limit, much greater power than is considered necessary will continue to be supplied, temperature control will be performed based on erroneous information, and temperature control will fail.

Also, when the PID computation value is lower than the lower limit, slightly more power than is considered necessary will continue to be supplied even if the power set value is set to 0, temperature control will be performed based on erroneous information, and temperature control will similarly fail.

To prevent this, in this temperature control, PWM control is performed in accordance with the ratio of the PID computation value to the lower limit, enabling temperature control to be performed without sacrificing inverter circuit protection.

The actual method used for this temperature control will be described below.

In FIG. 12, if the PID computation value is lower than the lower limit in step S1202, supply power computation section 301 sets the lower limit for the power set value (step S1206). Then supply power computation section 301 performs PWM control on/off duty calculation (step S1207).

For example, if the PID computation value is 20 (hexadecimal notation) HEX when the lower limit is 40 (hexadecimal) HEX, the on ratio is 50%. In this case, therefore, if PWM control with 50% on duty and 50% off duty is performed, a 20 HEX PID computation value power setting will appear to have been made.

To give another example, if the PID computation value is 10 (hexadecimal notation) HEX when the lower limit is 40 (hexadecimal) HEX, the on ratio is 25%. In this case, therefore, if PWM control with 25% on duty and 75% off duty is performed, a 10 HEX PID computation value power setting will appear to have been made.

Thus, when the PID computation value is lower than the lower limit, power setting is performed in accordance with PWM control on/off duty computed as described above. Here, a value obtained empirically while varying the process speed and so forth is used as the PWM control sampling cycle, an example being a value of 40 ms for the steady-state speed (100 mm/s) in this example.

Next, supply power computation section 301 waits for the duration of the PWM control on period calculated from the PWM control on/off duty and PWM control sampling cycle (step S1208). After this on period wait the IH control signal is turned off (step S1209), and supply power computation section 301 waits for the duration of the PWM control off period (step S1210).

Then, after the off period wait, supply power computation section 301 turns on the IH control signal (step S1211), and proceeds to the temperature control termination check (step S1212). If there is a temperature control termination request, supply power computation section 301 terminates temperature control and stops IH control. If there is no temperature control termination request, the processing flow returns to step S1201 and temperature control is continued.

As illustrated in FIG. 4, if the power supplied to the inverter circuit is detected to be greater than or equal to the limit value, or the power set value is greater than or equal to the limit value, during power rise control, during power correction control, or during temperature control, calorific value control section 300 controls the power set value so that the supply power becomes a value smaller than the target power (for example, a power value that is 80% of the target power), preventing IH control problems due to inverter circuit breakdown or malfunction.

As described above, a fixing apparatus that uses a conventional image heating apparatus employs two or more IGBTs to perform PID control of power supplied to the heat source, and thus has the disadvantages of high cost and poor efficiency.

It is therefore desirable for a fixing apparatus that uses this kind of image heating apparatus to have a configuration employing a single IGBT for its power source. However, a drawback of performing linear control with only one IGBT in this way is that high-frequency switching loss increases at low power, and minimum power only falls to around 400 W as IH output.

Thus, with calorific value control section 300 of this fixing apparatus 200, as shown in FIG. 13, linear control is performed when a PID control computation result is greater than or equal to the minimum power obtained as IH output, and when power lower than the minimum power is required, PWM control is performed at minimum power.

That is to say, with calorific value control section 300 of this fixing apparatus 200, temperature control computation is not varied according to the rotational speed of fixing belt 230, but it is determined whether the range allows temperature control with one IGBT, and the control method is switched to either linear control or PWM control.

While performing full-range control with PWM control is theoretically possible, realistically, turning a 0 to 1000 W range on and off at short time intervals, for example, will result in various adverse effects such as power source fluctuations and noise. Furthermore, if control power changes from 0 W to a level such as 1000 W instantaneously, there is a risk of control circuit breakdown. With a conventional control apparatus, large variations in the power source voltage are prevented by using two or more IGBTs and dividing the control range.

In contrast, in calorific value control section 300 of this fixing apparatus 200, as described above, when output is low—less than 500 W, for example—as a result of computation by supply power computation section 301, the calorific value of fixing belt 230 is controlled by means of PWM control. When output is high—500 W or higher, for example—the calorific value of fixing belt 230 is controlled by means of linear control.

According to this configuration, it is not necessary for the computation method of supply power computation section 301 to be switched according to the fixing speed, and the calorific value of fixing belt 230 can be controlled with one computation method. Therefore, in calorific value control section 300 of fixing apparatus 200, the supply power to the heat source of fixing belt 230 can be PID-controlled by only one switching element (IGBT), lower cost and higher efficiency can be achieved, and the temperature of fixing belt 230 can be maintained stably at the target temperature.

The power source voltage of fixing apparatus 200 differs according to the country or region. FIG. 14 is an explanatory drawing showing the relationship between the power source voltage and minimum power of fixing apparatus 200.As shown in FIG. 14, the minimum power of fixing apparatus 200 varies according to the power source voltage, with minimum power increasing as the power source voltage increases.

That is to say, when the power source voltage is low, low power can be output, and therefore linear control can be performed down to reference power (minimum power that can be output with one IGBT) of approximately 400 W, for example. Conversely, however, in an environment in which the power source voltage is a high 120 v or 130 v, for example, the minimum power exceeds 600 W, and therefore the reference power may be high.

Thus, the reference power is not necessarily a fixed value such as 500 W as mentioned above, but may become 400 W or exceed 500 W, for example, according to the power source voltage.

Thus, with calorific value control section 300 of this fixing apparatus 200, the reference power is varied by the power source voltage. According to this configuration, the calorific value of fixing belt 230 can be controlled without any trouble in different operating environments.

In switching between linear control and PWM control, it may be arranged, for example, for the current and voltage output to the inverter circuit to be monitored and power to be computed, and appropriate control to be selected by means of a table in accordance with this power.

In calorific value control section 300 of this fixing apparatus 200, the PWM control sampling cycle is changed according to the process speed of image forming apparatus 100. When the process speed is fast, it is necessary for the operation amount to be reflected quickly, and therefore a short sampling cycle is appropriate. As the process speed becomes slower, a longer sampling cycle becomes appropriate. This is conspicuous when the heating area of fixing belt 230 and the temperature detection area of temperature detector 270 are at a distance from each other.

For example, when the process speed is a slow 50 mm/sec and the control cycle is a short 50 msec, it takes time for a result in which the operation amount is reflected to be detected by temperature detector 270.In this case, therefore, if the operation amount is changed in a short sampling cycle a result reflecting the operation amount cannot be detected, the operation amount will rapidly become larger, and temperature ripple will increase.

Figure 16:
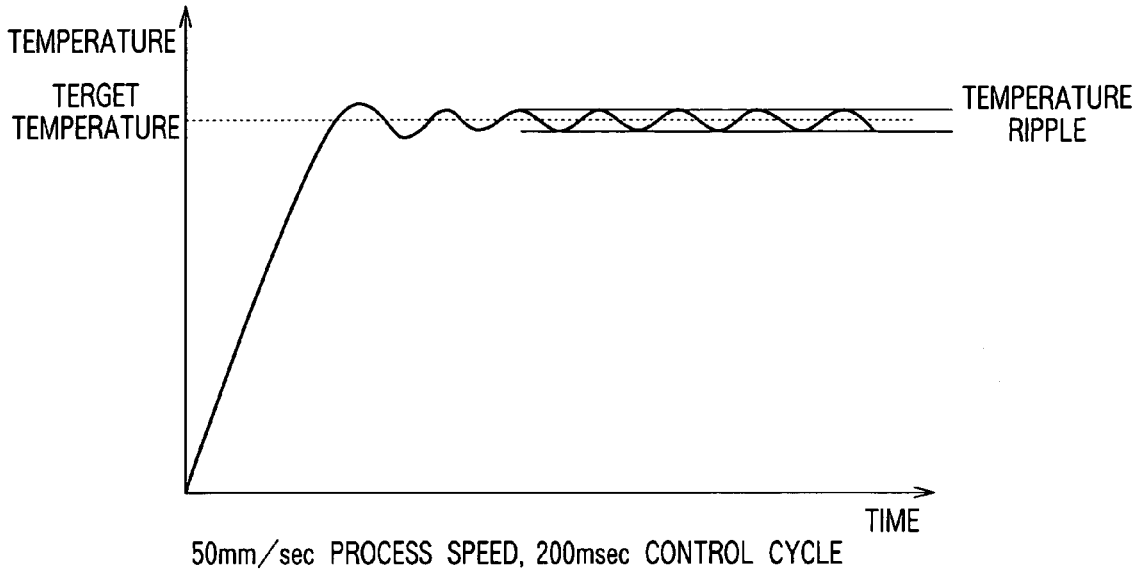
FIG. 16 is a graph showing belt temperature variation of the fixing belt when the process speed is 50 mm/sec and the control cycle is 200 msec according to this embodiment.

Therefore, in a case such as this in which the process speed is a slow 50 mm/sec, a fairly long sampling cycle is appropriate, such as the 200 msec control cycle shown in FIG. 16.

Figure 17:
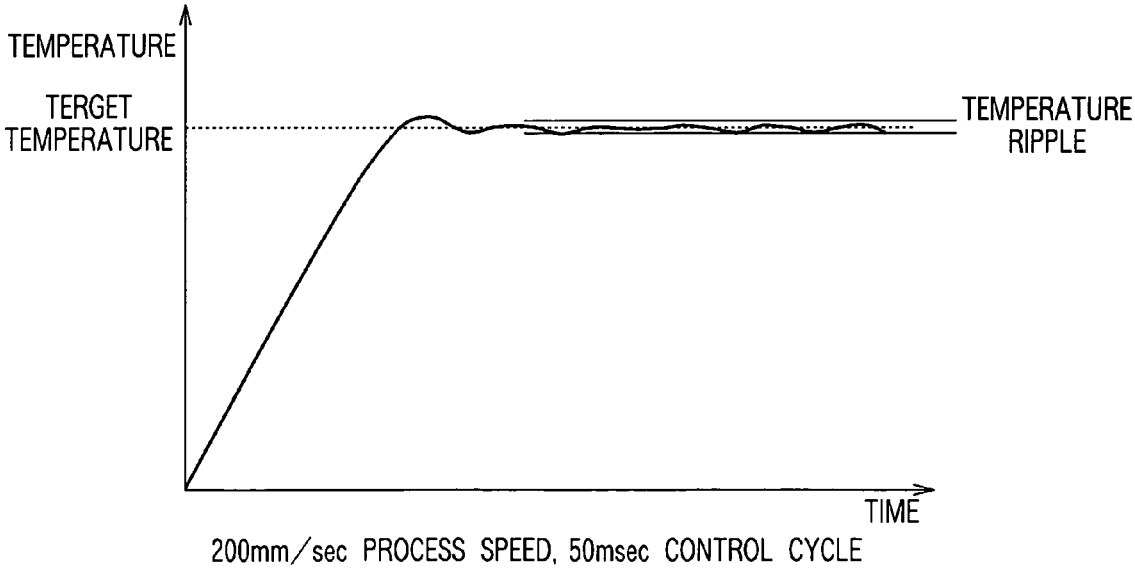
FIG. 17 is a graph showing belt temperature variation of the fixing belt when the process speed is 200 mm/sec and the control cycle is 50 msec according to this embodiment.

On the other hand, in the case of a fast process speed of 200 mm/sec, as shown in FIG. 17, a fairly short sampling cycle is appropriate, such as a 50 msec control cycle. That is to say, in this case, if the operation amount is varied in a long sampling cycle such as a 200 msec control cycle, as shown in FIG. 18, a result reflecting the operation amount cannot be detected, and therefore the operation amount will rapidly become larger and temperature ripple will increase.

Thus, in this fixing apparatus 200, an operation amount is reflected in heating and this is consequently an optimal sampling cycle corresponding to a time constant whereby this is read and detected by temperature detector 270. Therefore, in this fixing apparatus 200, temperature ripple increases in the event of deviation from the optimal sampling cycle.

Figures 18, 19:
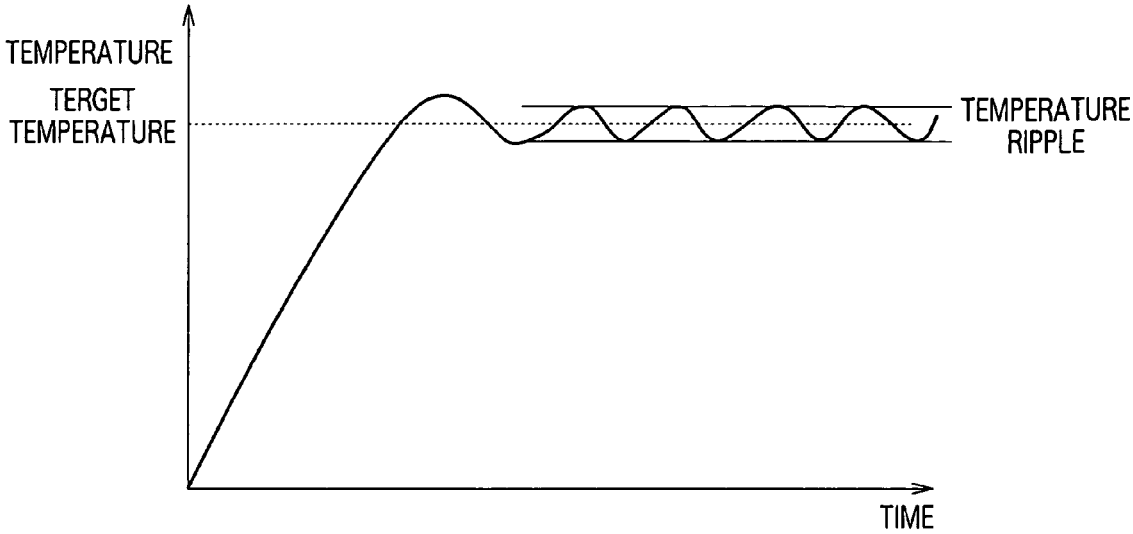
FIG. 18 is a graph showing belt temperature variation of the fixing belt when the process speed is 200 mm/sec and the control cycle is 200 msec according to this embodiment.
FIG. 19 is an explanatory drawing showing the relationship between the process speed, sampling cycle, and temperature ripple according to this embodiment.
Figure 20A:
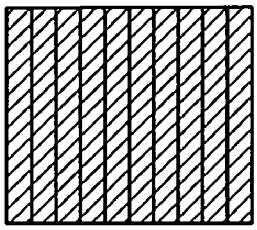
FIG. 20A is a schematic diagram showing 100% power source output in the cases of 10 divisions in PWM control according to this embodiment.
Figure 20B:
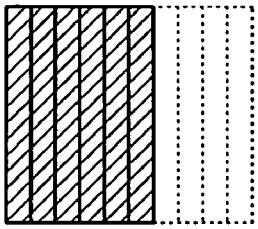
FIG. 20B is a schematic diagram showing 60% power source output in the cases of 10 divisions in PWM control according to this embodiment.
Figure 20C:
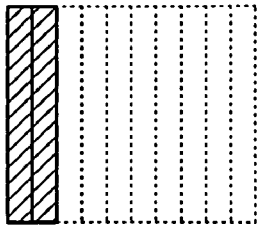
FIG. 20C is a schematic diagram showing 20% power source output in the cases of 10 divisions in PWM control according to this embodiment.
Figure 20D:
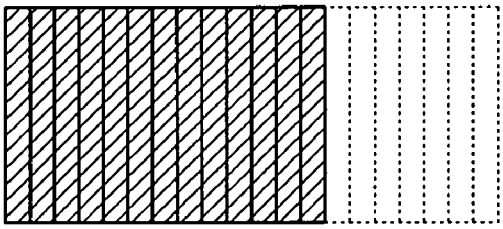
FIG. 20D is a schematic diagram showing 65% power source output in the cases of 20 divisions in PWM control according to this embodiment.
Figure 20E:
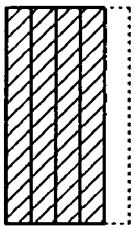
FIG. 20E is a schematic diagram showing 80% power source output in the cases of 5 divisions in PWM control according to this embodiment.

FIG. 19 is an explanatory drawing showing the relationship between the process speed, sampling cycle, and temperature ripple.

With PID control, an optimal value can be considered simply for the sampling time. However, with PWM control, if the sampling time is long, it is possible to achieve fine operation amount levels, but, if the sampling time is short and power source output is controlled in 10, 20, or 5 divisions as shown in FIG. 20A through FIG. 20E, operation amount levels of only a few stages can be achieved through trade-off with the control cycle of image forming apparatus 100.

Therefore, with this PWM control, there are more complex optimal values. In this example, an optimal value is ultimately found empirically.

In IH control, heat-producing roller 220 and fixing belt 230 produce heat in accordance with the magnetic flux distribution of induction heating apparatus 250.Consequently, fixing belt 230 is not heated uniformly when viewed in the heat-producing roller 220 cross-sectional direction, and a maximum temperature point is created according to the shape of exciting coil 253.

Therefore, it is desirable for temperature detector 270 that detects the temperature of fixing belt 230 to be positioned at this maximum temperature point in order for the result of temperature control to be reflected immediately.

Figure 21:
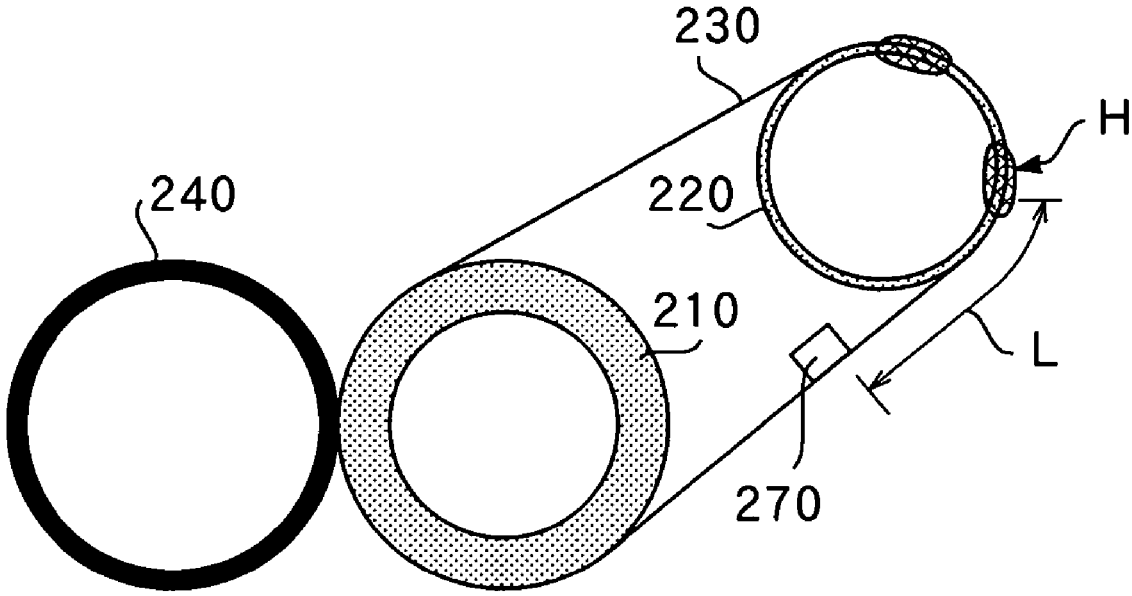
FIG. 21 is an explanatory drawing of sensing distance L from maximum temperature area H of the fixing belt to the temperature detection area of the temperature detector in a fixing apparatus according to this embodiment.
Figure 22A:
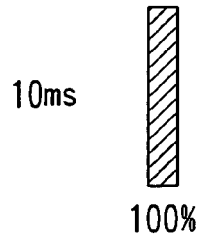
FIG. 22A is a schematic diagram showing 100% power source output when the sampling frequency is 10 ms in PWM control according to this embodiment.
Figure 22B:
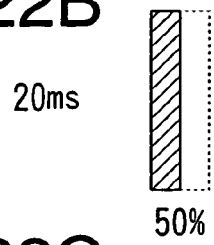
FIG. 22B is a schematic diagram showing 50% power source output when the sampling frequency is 20 ms in PWM control according to this embodiment.
Figure 22C:
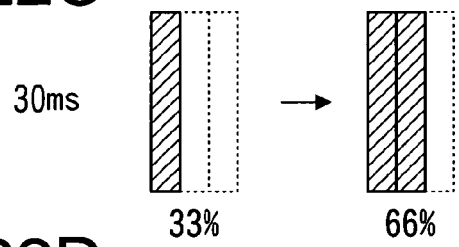
FIG. 22C is a schematic diagram showing 33% and 66% power source output when the sampling frequency is 30 ms in PWM control according to this embodiment.
Figure 22D:
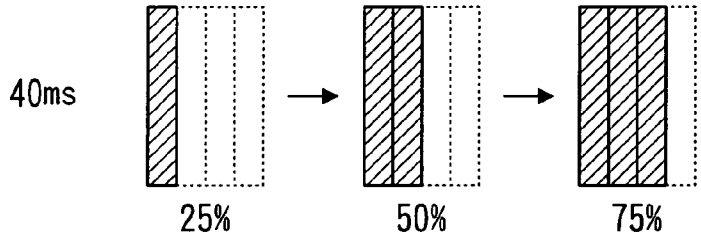
FIG. 22D is a schematic diagram showing 25%, 50%, and 75% power source output when the sampling frequency is 40 ms in PWM control according to this embodiment.
Figure 22E:
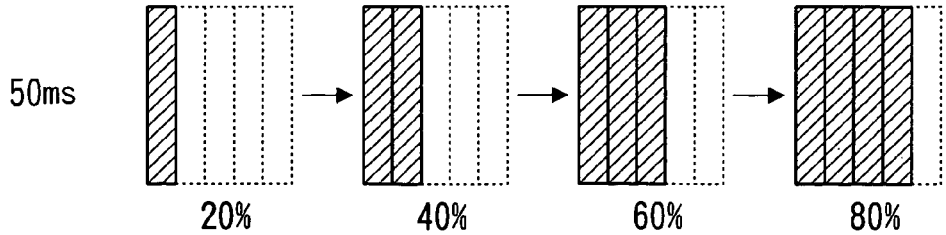
FIG. 22E is a schematic diagram showing 20%, 40%, 60%, and 80% power source output when the sampling frequency is 50 ms in PWM control according to this embodiment.
Figure 23A:
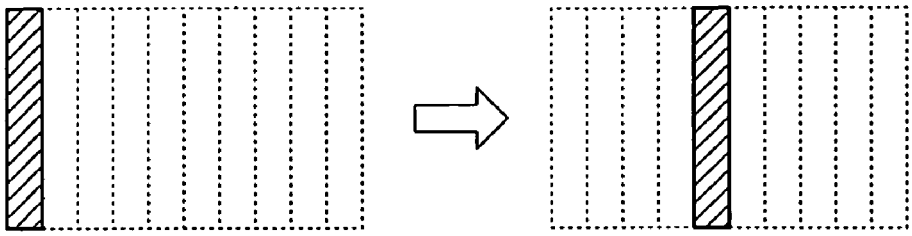
FIG. 23A is a schematic diagram showing offset control and distributed control 10% power source output in the case of 10 divisions in PWM control according to this embodiment.
Figure 23B:
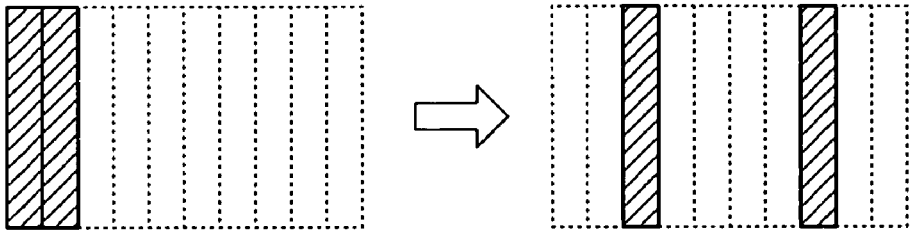
FIG. 23B is a schematic diagram showing offset control and distributed control 20% power source output in the case of 10 divisions in PWM control according to this embodiment.
Figure 23C:
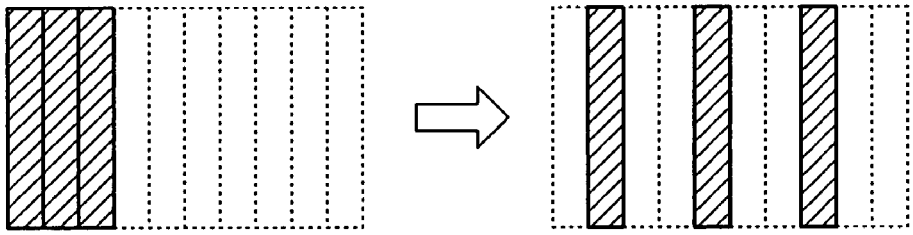
FIG. 23C is a schematic diagram showing offset control and distributed control 30% power source output in the case of 10 divisions in PWM control according to this embodiment.
Figure 23D:
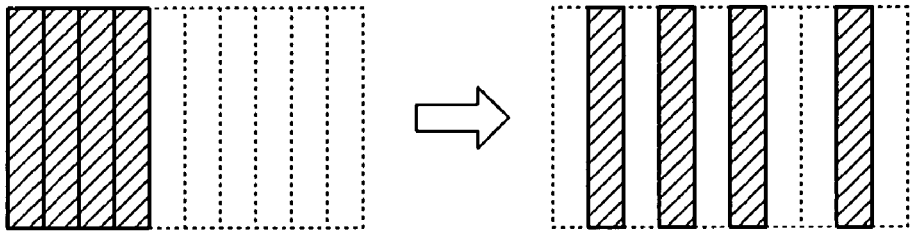
FIG. 23D is a schematic diagram showing offset control and distributed control 40% power source output in the case of 10 divisions in PWM control according to this embodiment.
Figure 23E:
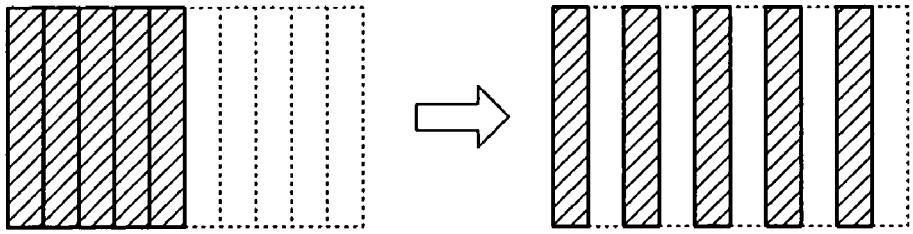
FIG. 23E is a schematic diagram showing offset control and distributed control 50% power source output in the case of 10 divisions in PWM control according to this embodiment.

However, this temperature detector 270 is often located at a slightly displaced location due to the shape of exciting coil 253 or the like. As shown in FIG. 21, with this fixing apparatus 200, in particular, since fixing belt 230 is used as an image heating element, sensing distance L from maximum temperature area H to the temperature detector 270 temperature detection area is long (in this example, 25 mm).

Therefore, in this fixing apparatus 200, the temperature of fixing belt 230 heated at a maximum temperature area is sensed by temperature detector 270 a predetermined time later.

Consequently, the sampling cycle in this fixing apparatus 200 must not exceed the time taken to travel sensing distance L from maximum temperature area H to the temperature detection area of temperature detector 270 at the process speed. This sampling cycle should preferably not exceed ½ the time taken to travel sensing distance L from maximum temperature area H to the temperature detector 270 temperature detection area at the process speed.

Incidentally, in this fixing apparatus 200, if the process speed is a slow 50 mm/sec, such as when fixing thick paper, for example, the time necessary for sensing is approximately 500 ms, and the optimal control cycle is 200 ms. Also, when the process speed is a fast 200 mm/sec, such as when fixing a black-and-white image (printing 20 sheets per minute) or color image (printing 16 sheets per minute), the time necessary for sensing is approximately 125 ms, and the optimal control cycle is 50 ms.

In PWM control, normally the sampling cycle is fixed and only the pulse width changes, but in this case only the value of the number of divisions according to the control cycle of image forming apparatus 100 can be obtained.

Thus, it is possible to obtain finer output levels by changing the PWM control sampling cycle according to PID control computation results, as shown in FIG. 22A through FIG. 22E.

When PWM control is performed with the sampling cycle fixed, the reference point is normally fixed while the width is varied, but since output can be turned on and off according to the image forming apparatus 100 control cycle, equivalent output can be obtained by distributing on and off times as shown in FIG. 23A through FIG. 23E. An advantage of this method is that off time does not continue for a long period, and, consequently, there is less temperature ripple.

Figure 24:
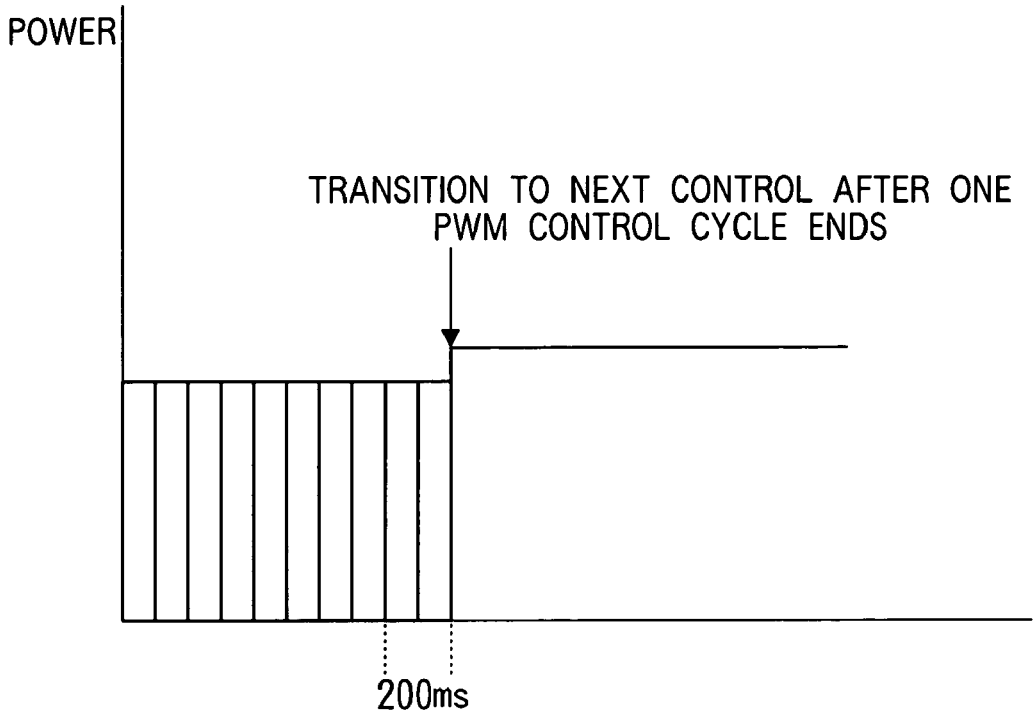
FIG. 24 is a graph of power in a system in which a transition is made to the next control after one cycle of PWM control ends according to this embodiment.

In PWM control, it is normally not possible to proceed to the next control before a predetermined sampling cycle ends. Therefore, even if PID control computation is performed every image forming apparatus 100 control cycle (in this example, 10 ms), in the case of a 200 ms PWM control cycle, for example, as shown in FIG. 24, a change cannot be made to the next output until a 200 ms period has elapsed. This is not a problem when only PWM control is used, but in a case where linear control is returned to for some reason, such as environmental temperature fluctuation or power source voltage fluctuation, reaction is delayed correspondingly.

Figure 25:
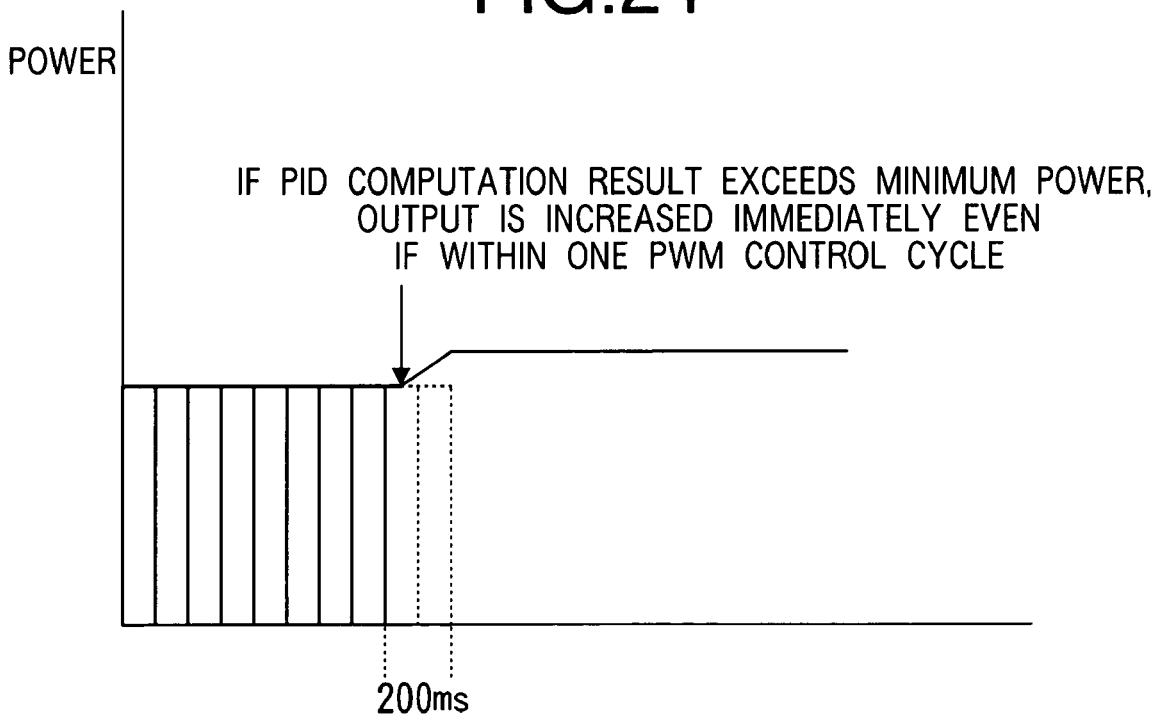
FIG. 25 is a graph of power in a system in which output is increased within one cycle of PWM control when a PID control computation result exceeds the minimum power according to this embodiment.

Thus, in calorific value control section 300 of fixing apparatus 200, linear control is returned to immediately when a PID control computation result reaches or exceeds the minimum power at which PWM control is performed, as shown in FIG. 25.

Figure 26:
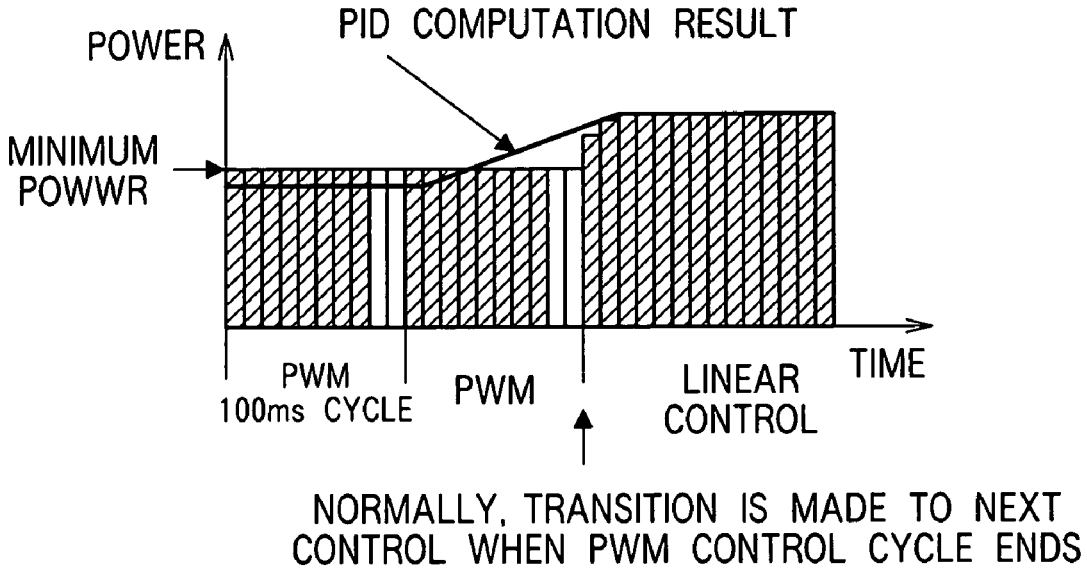
FIG. 26 is a graph of power in a system in which a transition is made to the next linear control at the point at which a PWM control cycle ends according to this embodiment.

Also, in calorific value control section 300 of this fixing apparatus 200, a transition is normally made to the next linear control at the point at which a PWM control cycle ends, as shown in FIG. 26. However, with this control, time is needed before a transition is made from PWM control to linear control.

Figure 27:
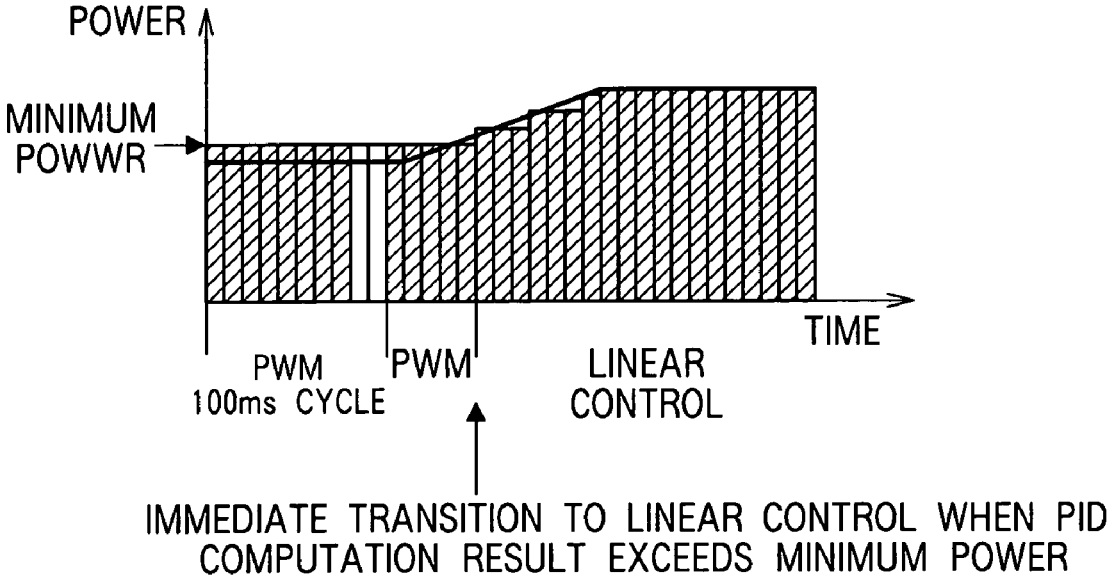
FIG. 27 is a graph of power in a system in which a transition is made to linear control immediately at the point at which a PID control computation result exceeds the minimum power according to this embodiment.

Thus, in calorific value control section 300 of this fixing apparatus 200, provision may be made for a transition to be made to linear control immediately at the point at which a PID control computation result exceeds the minimum power, as shown in FIG. 27.

A first aspect of an image heating apparatus of the present invention employs a configuration comprising an image heating element that heats an unfixed image on a recording medium; a heat-producing section that heats the image heating element; a temperature detection section that detects the temperature of the image heating element; and a calorific value control section that controls the calorific value of the heat-producing section based on the temperature detected by the temperature detection section so that the temperature of the image heating element is maintained at an image fixing temperature suitable for heat-fixing of the unfixed image onto the recording medium, wherein the calorific value control section controls the calorific value of the heat-producing section by switching between linear control and PWM control at predetermined reference power.

According to this configuration, based on a computation result of the calorific value control section, when output is low the calorific value of the heat-producing section is controlled by means of PWM control, and when output is high the calorific value of the heat-producing section is controlled by means of linear control. That is to say, according to this configuration, it is not necessary for the computation method of the calorific value control section to be switched according to the fixing speed, and the calorific value of the heat-producing section can be controlled with one computation method. Therefore, with this configuration, the supply power to the heat source of the heat-producing section can be PID-controlled by only one switching element (IGBT), enabling lower cost and higher efficiency to be achieved, and the temperature of the image heating element to be maintained stably at a target temperature.

A second aspect of an image heating apparatus of the present invention employs a configuration wherein, in the image heating apparatus described in the above first aspect, the reference power varies with the power source voltage.

The power source voltage differs according to the country or region. In an environment in which the power source voltage is low, low power can be output, and it is therefore possible to lower the reference power, and linear control can be performed down to approximately 400 W, for example. Conversely, in an environment in which the power source voltage is high, low power cannot be output, and linear control is difficult even at 500 W, for example. According to this configuration, in addition to the effects of the invention according to the first aspect, the reference power varies with the power source voltage, enabling the calorific value of the heat-producing section to be controlled without any trouble in different operating environments. In switching between linear control and PWM control, it may be arranged, for example, for the output current and voltage to be monitored and power to be computed, and appropriate control to be selected by means of a table in accordance with this power.

A third aspect of an image heating apparatus of the present invention employs a configuration comprising an image heating element that heats an unfixed image on a recording medium; a heat-producing section that heats the image heating element; a temperature detection section that detects the temperature of the image heating element; and a calorific value control section that controls the calorific value of the heat-producing section based on the temperature detected by the temperature detection section so that the temperature of the image heating element is maintained at an image fixing temperature suitable for heat-fixing of the unfixed image onto the recording medium, wherein the calorific value control section controls the calorific value of the heat-producing section by switching between linear control and PWM control at predetermined reference power, and changes the sampling cycle of PWM control in accordance with the rotational speed of the image heating element.

When the area of heating of the image heating element by the heat-producing section and the area of detection of the temperature of the image heating element by the temperature detection section are at a distance from each other, if the PWM control sampling cycle is fixed, the number of computations of the calorific value control section differs according to the rotational speed of the image heating element. That is to say, when the rotational speed of the image heating element is slower, the number of computations of the calorific value control section increases. Consequently, when the rotational speed of the image heating element is slow, overly fine sampling is performed, misses increase, and output rises. As a result, the temperature of the image heating element is set higher than necessary, temperature ripple increases, and the control width is extended. According to this configuration, the PWM control sampling cycle is changed in accordance with the rotational speed of the image heating element, enabling the temperature of the image heating element to be set appropriately, temperature ripple to be reduced, and the control width to be narrowed. As the optimal value of the PWM control sampling cycle actually also varies due to other factors such as the time constant of the temperature detection section, a setting of not more than ½ the time necessary for temperature detection section sensing is desirable.

A fourth aspect of an image heating apparatus of the present invention employs a configuration wherein, in the image heating apparatus described in the above third aspect, the calorific value control section sets a larger value of the sampling cycle of PWM control at a slower rotational speed of any two rotational speeds of a plurality of rotational speeds of the image heating element.

The time necessary for temperature detection section sensing is longer for the slower rotational speed of any two rotational speeds of a plurality of rotational speeds of the image heating element. According to this configuration, the PWM control sampling cycle value is made larger for the slower rotational speed, enabling an increase in the temperature ripple width due to ineffective control by the calorific value control section to be prevented.

A fifth aspect of an image heating apparatus of the present invention employs a configuration wherein, in the image heating apparatus described in the above third aspect, the calorific value control section performs PWM control with a sampling cycle shorter than the time in which the image heating element travels the distance from the maximum temperature area of the image heating element to the temperature detection area of the temperature detection section at a predetermined process speed.

According to this configuration, since PWM control is performed with a sampling cycle shorter than the time in which the image heating element travels the above-described distance at a predetermined process speed, calorific value control section control can be reflected dependably.

A sixth aspect of an image heating apparatus of the present invention employs a configuration wherein, in the image heating apparatus described in the above first aspect, the PWM control sampling cycle is changed according to the PWM control duty ratio computed by the calorific value control section.

In PWM control, normally the sampling cycle is fixed and only the pulse width changes, but in this case only the value of the number of divisions according to the control cycle of image forming apparatus can be obtained. According to this configuration, it is possible to obtain finer output levels since the PWM control sampling cycle is changed according to the PWM control duty ratio.

A seventh aspect of an image heating apparatus of the present invention employs a configuration wherein, in the image heating apparatus described in the above third aspect, the calorific value control section distributes the PWM control on time within a control cycle.

When PWM control is performed with the sampling cycle fixed, the reference point is normally fixed while the width is varied, but since output can be turned on and off according to the image forming apparatus control cycle, equivalent output can be obtained by distributing on and off times. According to this configuration, since the PWM control on time is distributed within a control cycle, off time does not continue for a long period and there is little temperature ripple.

An eighth aspect of an image heating apparatus of the present invention employs a configuration wherein, in the image heating apparatus described in the above first aspect, the calorific value control section switches to linear control without waiting for the end of a PWM control cycle at a point in time when the PID control cycle of linear control becomes smaller than the control cycle of PWM control and a condition is established that enables a transition to linear control within the control cycle of PWM control.

In PWM control, it is normally not possible to proceed to the next control before a predetermined sampling cycle ends. Therefore, even if PID control computation is performed every image forming apparatus control cycle, in the case of a 200 ms PWM control cycle, for example, a change cannot be made to the next output until a 200 ms period has elapsed. This is not a problem when only PWM control is used, but in a case where linear control is returned to for some reason, such as environmental temperature fluctuation or power source voltage fluctuation, reaction is delayed correspondingly. According to this configuration, since switch over is performed to linear control when a condition that enables a transition to linear control is established, without waiting for the end of a PWM control cycle, control delays due to the sampling cycle can be prevented.

A ninth aspect of a fixing apparatus of the present invention employs a configuration comprising an image heating section that heats an unfixed image on a recording medium, wherein the image heating apparatus described in the above first aspect is used as the image heating section.

According to this configuration, since the image heating apparatus described in the above first aspect is used as the image heating section, it is possible to provide a fixing apparatus with a low-cost, high-efficiency configuration that enables the temperature of the image heating element to be maintained stably at a target temperature.

A tenth aspect of an image forming apparatus of the present invention employs a configuration comprising an imaging section that forms an unfixed image on a recording medium; and a fixing section that heat-fixes an unfixed image formed on the recording medium, wherein the fixing apparatus described in the above ninth aspect is used as the fixing section.

According to this configuration, since the fixing apparatus described in the above ninth aspect is used as the fixing section, it is possible to provide an image forming apparatus that can heat-fix an unfixed image on the recording medium at an appropriate fixing temperature.

The present application is based on Japanese Patent Application No. 2004-068032 filed on Mar. 10, 2004, the entire content of which is expressly incorporated by reference herein.

INDUSTRIAL APPLICABILITY

The present invention enables the temperature of an image heating element to be maintained stably at a target temperature even when the fixing speed of a fixing apparatus of an image forming apparatus such as a copier, facsimile machine, or printer varies, and makes it possible to achieve lower cost and higher efficiency.

The invention claimed is:

1. An image heating apparatus comprising:

an image heating element that heats an unfixed image on a recording medium;

a heat-producing section that heats said image heating element;

a temperature detection section that detects a temperature of said image heating element; and a calorific value control section that controls a calorific value of said heat-producing section based on a temperature detected by said temperature detection section so that a temperature of said image heating element is maintained at an image fixing temperature suitable for heat-fixing of said unfixed image onto said recording medium, wherein said calorific value control section controls a calorific value of said heat-producing section by switching between linear control and PWM control at a predetermined reference power.

2. The image heating apparatus according to claim 1, wherein said reference power varies with power source voltage.

3. An image heating apparatus comprising:

an image heating element that heats an unfixed image on a recording medium;

a heat-producing section that heats said image heating element;

a temperature detection section that detects a temperature of said image heating element; and a calorific value control section that controls a calorific value of said heat-producing section based on the temperature detected by said temperature detection section so that the temperature of said image heating element is maintained at an image fixing temperature suitable for heat-fixing of said unfixed image onto said recording medium, wherein said calorific value control section controls the calorific value of said heat-producing section by switching between linear control and PWM control at a predetermined reference power, and changes a sampling cycle of said PWM control in accordance with rotational speed of said image heating element.

4. The image heating apparatus according to claim 3, wherein said calorific value control section sets a larger value of said sampling cycle of said PWM control at a slower rotational speed of any two rotational speeds of a plurality of rotational speeds of said image heating element.

5. The image heating apparatus according to claim 3, wherein said calorific value control section performs said PWM control with a sampling cycle shorter than a time in which said image heating element travels a distance from a maximum temperature area of said image heating element to a temperature detection area of said temperature detection section at a predetermined process speed.

6. The image heating apparatus according to claim 1, wherein a sampling cycle of said PWM control is changed according to a duty ratio of said PWM control computed by said calorific value control section.

7. The image heating apparatus according to claim 3, wherein said calorific value control section distributes on time of said PWM control within a control cycle.

8. The image heating apparatus according to claim 1, wherein said calorific value control section switches to linear control without waiting for an end of a cycle of said PWM control at a point in time when a PID control cycle of said linear control becomes smaller than a control cycle of said PWM control and a condition is established that enables a transition to said linear control within a control cycle of said PWM control.

9. A fixing apparatus comprising an image heating section that heats an unfixed image on a recording medium, wherein the image heating apparatus according to claim 1 is used as said image heating section.

10. An image forming apparatus comprising:

an imaging section that forms an unfixed image on a recording medium; and a fixing section that heat-fixes an unfixed image formed on said recording medium, wherein the fixing apparatus according to claim 9 is used as said fixing section.

* * * * *